US008303364B2

(12) United States Patent
Corsiglia et al.

(10) Patent No.: US 8,303,364 B2
(45) Date of Patent: Nov. 6, 2012

(54) TRANSFORMABLE TOY VEHICLE

(75) Inventors: Jeff Corsiglia, Sooke (CA); Charles Sink, Friday Harbor, WA (US); Mark Ladislao, Kowloon (CN)

(73) Assignee: Spin Master Ltd., Toronto, Ontario (CA)

( * ) Notice: Subject to any disclaimer, the term of this patent is extended or adjusted under 35 U.S.C. 154(b) by 76 days.

(21) Appl. No.: 12/884,443

(22) Filed: Sep. 17, 2010

(65) Prior Publication Data

US 2011/0065351 A1 Mar. 17, 2011

Related U.S. Application Data

(63) Continuation-in-part of application No. 12/012,974, filed on Feb. 6, 2008, now Pat. No. 8,187,049.

(60) Provisional application No. 60/899,950, filed on Feb. 7, 2007.

(51) Int. Cl.
*A63H 27/127* (2006.01)

(52) U.S. Cl. ..... 446/37; 446/57

(58) Field of Classification Search ..... 446/37
See application file for complete search history.

(56) References Cited

U.S. PATENT DOCUMENTS

| | | | | |
|---|---|---|---|---|
| 2,801,494 | A * | 8/1957 | Ernst | 446/37 |
| 4,480,400 | A * | 11/1984 | diDonato | 446/188 |
| 4,504,239 | A | 3/1985 | Kulesza et al. | |
| 5,785,576 | A * | 7/1998 | Belton | 446/456 |
| 2006/0231677 | A1 * | 10/2006 | Zimet et al. | 244/17.23 |
| 2007/0298675 | A1 * | 12/2007 | Lugo | 446/57 |
| 2008/0207079 | A1 | 8/2008 | Corsiglia et al. | |
| 2009/0104836 | A1 * | 4/2009 | Van de Rostyne et al. | 446/37 |
| 2009/0124162 | A1 * | 5/2009 | Martino | 446/57 |

OTHER PUBLICATIONS http://www.intrafin.be/Toys/Nikko/Special_Action/Special_ActionJ_Kart.html?sid=8flfcdf648fd83593f464b73f8b5519e (accessed Apr. 1, 2010) http://www.nikko-rc.com/ (accessed Nov. 18, 2010).

* cited by examiner

*Primary Examiner* — Tramar Harper
(74) *Attorney, Agent, or Firm* — Cozen O'Connor

(57) ABSTRACT

A remote controlled transformable toy vehicle that is remotely transformable from a standing position to a flying position, where the toy performs like a helicopter and also to a driving position, where the toy performs like a wheeled vehicle. Transformations are carried out on-the-fly by remote control and the toy vehicle has the ability to maintain proper center of gravity for stable flight, takeoff and landing. Also provided is a remotely controlled toy vehicle that is driven by a rotating blade system so as to both drive over the ground and hover or fly in the air.

12 Claims, 33 Drawing Sheets

TRANSFORMABLE TOY VEHICLE

RELATED APPLICATIONS

This application is a continuation-in-part of U.S. patent application Ser. No. 12/012,974, filed Feb. 6, 2008, which claims priority from U.S. Provisional Patent Application Ser. No. 60/899,950, filed Feb. 7, 2007.

BACKGROUND OF THE INVENTION

1. Field of the Invention

The present invention relates to a transformable toy vehicle generally and more specifically to a remotely controlled toy vehicle that is remotely transformable from a standing position, to a flying position where the toy performs like a helicopter, and also to a driving position where the toy performs like a wheeled vehicle. The present invention also relates to a toy vehicle which is driven by a rotating blade system so as to both drive over the ground and hover or fly in the air.

2. Description of the Related Art

There are various kinds of transformable toy vehicles known in the art. Most such toy vehicles feature a conversion of form that is mainly restricted only to the change of the outer appearance. The conversion is carried out by adding or deleting one or more of the constituting elements of the toy vehicle.

There are also transformable toy vehicles that can be transformed without adding or deleting constituent elements. These transformable toy vehicles are mostly of the type in which the form of a car is converted into other forms. For example, the form of a sports car is converted into a robot form.

The form of conversion where the toy vehicle converts from a robot or other object that can stand erect to a toy vehicle that can fly like a helicopter, and then to one that can drive on the ground like a wheeled vehicle, and back again, is not found in the prior art.

There is, therefore, a need for an innovative transformable toy vehicle that is transformable from a standing position to a flying position, where the toy performs like a helicopter and also to a driving position, where the toy performs like a wheeled vehicle.

There is a further need for a transformable toy vehicle that can make the above-noted transformations by dynamically transforming from one position to the next all while balancing all in-flight forces and maintaining the correct center of gravity for stable flight, takeoff and landing.

There is also a need for a transformable toy vehicle where the above-noted transformations are accomplished automatically by remote control signals and can be done while the transformable toy vehicle is in flight.

There is a further need for a transformable toy vehicle that can land in any one of at least two different positions.

There is another need for a transformable toy vehicle that can be steered, both in the air and on the ground, by differentially driving at least two separate counter-rotating rotor blades at different relative speeds.

SUMMARY OF THE INVENTION

In one aspect of the present invention, there is provided a transformable toy vehicle comprising: a main upper body portion; a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis; a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis; a main drive means connected to said main drive shaft for driving the at least two lifting blades; and a vehicle control unit for controlling said main drive means in response to remote control signals, said vehicle control unit comprising: a micro-processor with memory; and a receiver for receiving said remote control signals.

In another aspect, there is provided a transformable toy vehicle comprising: a main upper body portion; a lower body portion rotatably connected to said upper body portion, said lower body portion being selectively retainable at various angles relative to an upper body central axis between a first body position where said upper body central axis is generally parallel with a lower body central axis and a second body position where said upper body central axis is at approximately a 90 degree angle relative to said lower body central axis; a rotating blade system including a main drive shaft and at least two lifting blades connected to said drive shaft, said rotating blade system mounted to a back portion of said upper body portion such that said main drive shaft is generally perpendicular to said upper body central axis, and said lifting blades are generally parallel to said upper body central axis; at least two arms rotatably affixed to said main upper body portion, said arms being rotatable between a first backward-facing flying position and a second forward-facing driving position; at least two legs rotatably affixed to said lower body portion, said legs rotatable on a common plain between a first position parallel to said lower body central axis and a second position wherein said legs are spread-apart forming an acute angle with said lower body central axis; a main drive means connected to said main drive shaft for driving the at least two lifting blades; an auxiliary body drive means for selectively rotating said upper body portion with respect to said lower body portion between said first body position and said second body position; an auxiliary arm drive means for driving said rotation of said arms between said first flying position and said second driving position; an auxiliary leg drive means for driving said rotation of said legs between said first parallel position and said second spread-apart position; an auxiliary rotating blade system drive means for moving said rotating blade system forward and backward on said upper body portion parallel with said upper body central axis; and a vehicle control unit for controlling said main drive means, said auxiliary drive means, said auxiliary arm drive means, said auxiliary leg drive means and said auxiliary blade system drive means in response to remote control signals, said vehicle control unit comprising: a micro-processor with memory; and a receiver for receiving said remote control signals.

Another aspect of the present invention provides a toy vehicle having a vehicle body and a support system attached to the vehicle body which supports the vehicle body for movement in contact with a ground surface. The toy vehicle also has a rotating blade system attached to the vehicle body which can act to both drive the toy vehicle over the ground surface and lift the toy vehicle from the ground surface. The rotating blade system is powered by a power source. A vehicle control unit having a micro-processor with memory and a receiver for receiving remote control signals controls the support system and the rotating blade system in response to remote control signals.

BRIEF DESCRIPTION OF THE DRAWINGS

The present invention will be understood and appreciated more fully from the following detailed description, taken in conjunction with the drawings in which:

FIGS. 29A to 29C are circuit diagrams for a remote control transmitter for the toy vehicle of FIG. 26, in which RA0, RA1 and RA3 each represent program plug, RA2, RA5, RC2 and RC3 each represent NC, RA4 represents Voltage sense, RC0 represents ESC, RC1 represents Tail rotor, RC4 represents LED status and RC5 represents IR in.

DETAILED DESCRIPTION OF PREFERRED EMBODIMENTS

Figure 1:
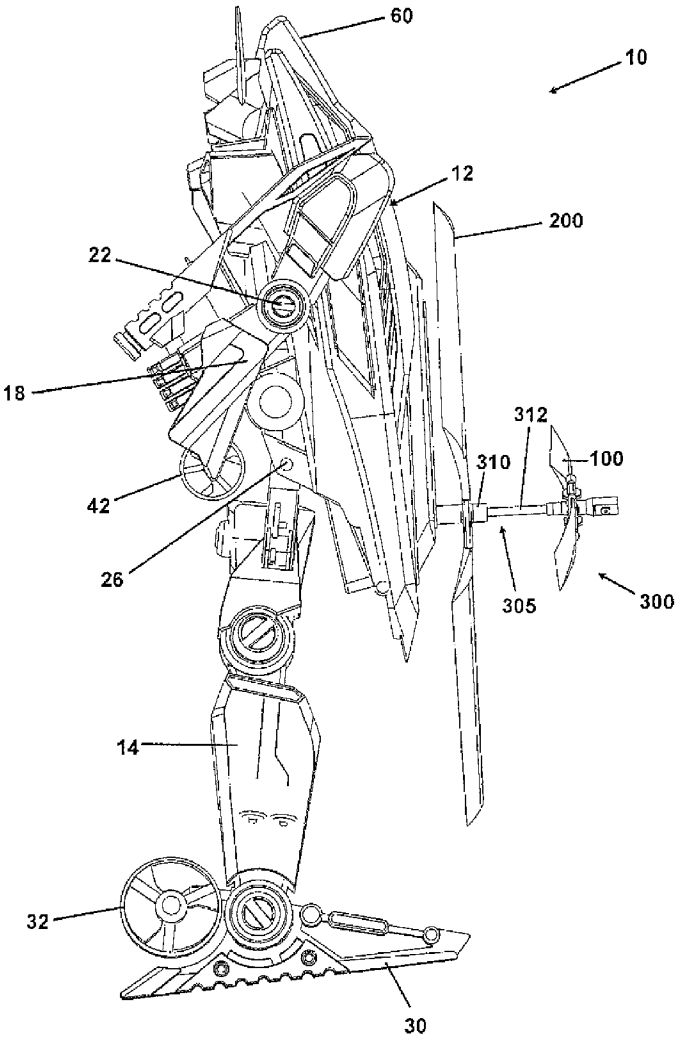
FIG. 1 is a left side view of the transformable toy vehicle in a standing position.

Reference is now made to FIGS. 1 to 5, which show a transformable toy vehicle 10 in a vertical standing position, having a main upper body portion or torso 12, a lower body portion or legs 14 and 16, and arms 18 and 20. In the standing position shown in FIGS. 1 to 5, a main body portion central axis is generally parallel to a lower body portion central axis. Arms 18 and 20 are rotatably affixed to main body 12 on a shaft 22 driven by a servo motor connected to a cam plate 24 and a gear train 25 (see FIGS. 21 and 22). Legs 14 and 16 are rotatably affixed to main body 12 on a shaft 26, permitting main body 12 to rotate forward relative to the legs 14, 16. Main body 12 is selectively retainable at various angles relative to the legs 14, 16 between a first position shown in FIGS. 1 to 5 where the main body central axis is generally parallel to the lower body central axis and a second takeoff/landing position shown in FIGS. 6 to 10 where the main body central axis is at approximately a 90 degree angle relative to the lower body central axis. For example, main body 12 may also be retained in a driving position, as shown in FIGS. 16 to 20. Shaft 26 is also driven by a servo-motor, cam plate and gear train system. To provide stability when in the standing and diving positions, legs 14 and 16 can be spread apart from each other on pivot points 28, driven by a gear system 29 connected to a servo motor.

Legs 14, 16 are each provided with skids or feet 30. Feet 30 are positioned to be engagable with the ground to provide stability for the transformable toy vehicle 10 when in the standing and takeoff/landing modes. In the driving position, as shown in FIGS. 16 to 20, feet 30 are positioned up off the ground so as not to make contact with the surface.

Legs 14, 16 are each provided with freely rotatable wheels 32 and arms 18 and 20 are each provided with freely rotatable wheels 42. As shown in FIGS. 16 to 20, wheels 32 and 42 are positioned to be engaged with the ground when the transformable toy vehicle 10 is in the driving position, permitting the transformable toy vehicle 10 to be driven over the surface like a wheeled vehicle.

A rotating blade system 300 is affixed to the back portion of main body 12. Rotating blade system 300 includes two counter-rotating blades, a lower rotor blade 200 and an upper rotor blade 100. A main coaxial drive shaft 305 provides rotating power to the two counter-rotating blades 100, 200. The main coaxial drive shaft 305 consists of two parts: an outer main drive shaft 310 and an inner main drive shaft 312. Outer main drive shaft 310 is driven by an outer drive shaft motor and gear system to provide rotating power to the lower blade 200. Inner main drive shaft 312 is driven by a separate inner drive shaft motor and gear systems to provide rotating power to the upper blade 100. The two parts of main coaxial drive shaft 305 rotate in opposite directions and can be driven at different speeds, if required, for steering the transformable toy vehicle 10 in the air and on the ground. The counter-rotating movement of the two blades 100, 200, cancel each other's angular torque and provide stability.

The two counter-rotating blades 100 and 200 provide lifting force for the transformable toy vehicle 10 when in the takeoff mode shown in FIGS. 6 to 10 and in the flying mode shown in FIGS. 11 to 15, and forward driving force when in the driving mode shown in FIGS. 16 to 20.

The blades 100 and 200 each have a slight forward bias and can be driven at different relative speeds by the separate inner and outer drive shaft motors, respectively. When blades 100 and 200 are driven at different relative speeds, side forces are developed, which when combined with the slight forward bias of the blades can be used to steer the transformable toy vehicle 10 while in both the flying and the driving modes.

Rotating blade system 300 may include bell stabilizers 106 (see FIGS. 22 and 23) connected to the coaxial drive shaft 305 adjacent the upper 100 and/or lower 200 blades.

Figure 22:
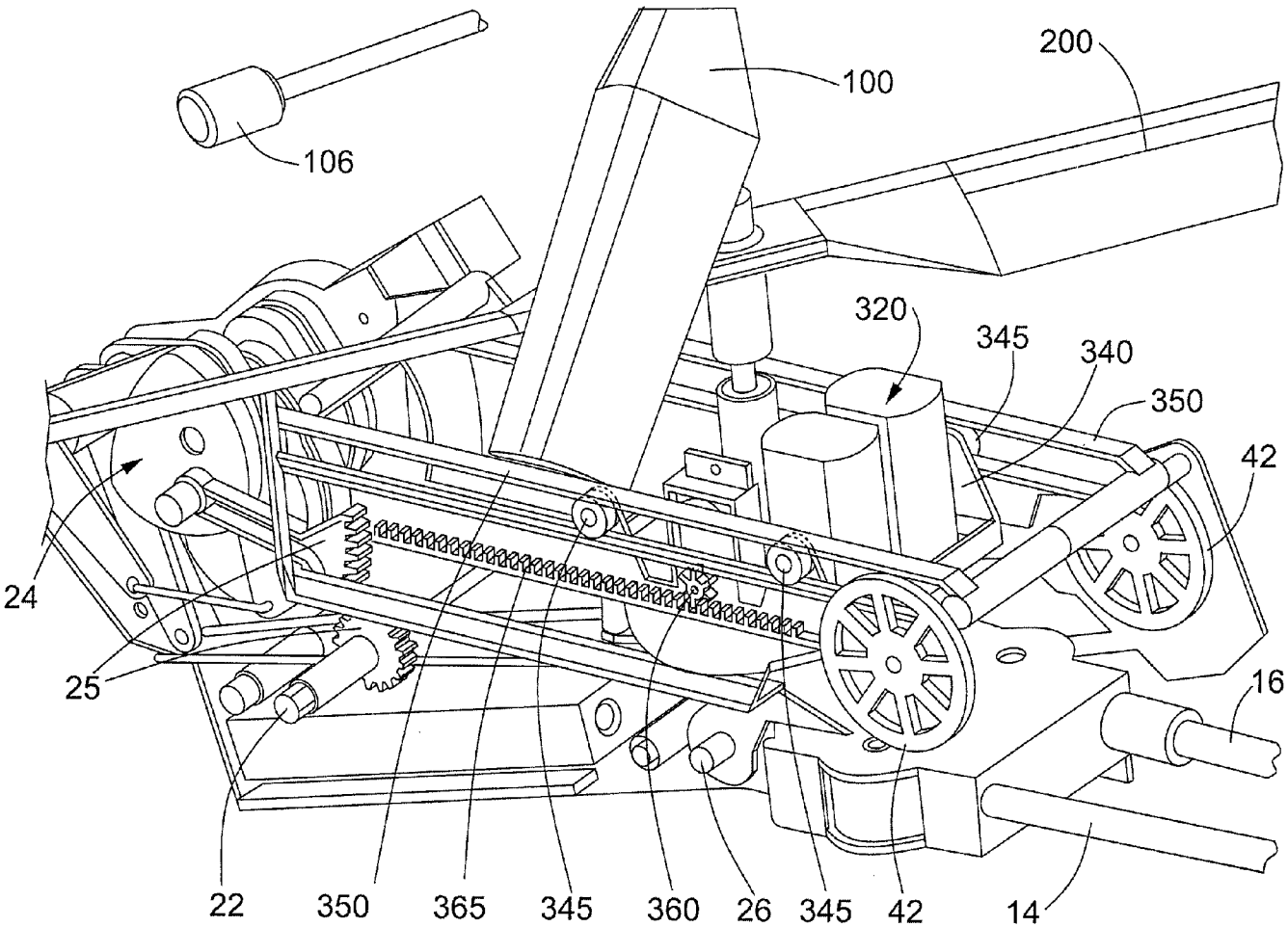
FIG. 22 is a left side perspective, cut-away, partial interior view of the transformable toy vehicle with the shell coverings removed.
Figure 23:
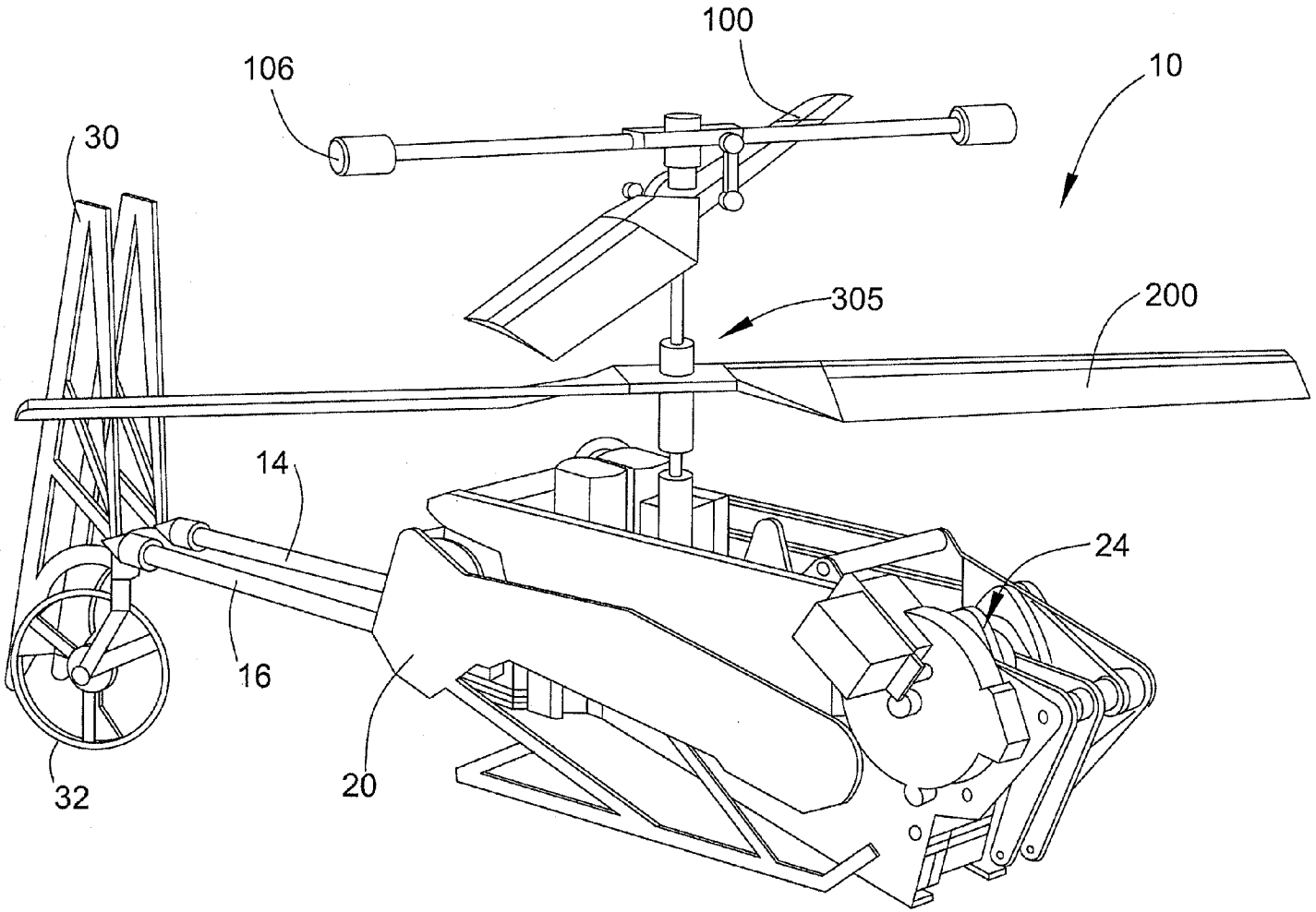
FIG. 23 is a right side perspective, view of the transformable toy vehicle in the flying position with the shell coverings removed.

Rotating blade system 300 includes a main drive power assembly 320 as shown in FIG. 22 to provide power to the inner and outer drive shaft motors, respectively. Power assembly 320 may be a rechargeable battery, simple battery, capacitance device, super capacitor, micro power capsule, fuel cells, fuel or other micro power sources.

Rotating blade system 300, is mounted to a carrier frame 340, including a set of rollers 345 engaged with rails 350 aligned parallel and connected to the main body 12. A drive gear 360 engaged with a toothed rack 365 affixed to main body 12 is driven by a servo motor and moves the entire rotating blade system 300 forward and backward on main body 12, along rails 350, to ensure that the proper center of gravity is at all times maintained for stable flight as the main body 12, the legs 14, 16 and the arms 18, 20 rotate relative to each other to transform the toy vehicle 10 into the different configurations shown herein.

The transformable toy vehicle 10 includes a vehicle control unit (not shown) comprising a circuit board including a radio receiver and a micro-processor with memory for controlling the entire operation of the transformable flying toy vehicle 10. The vehicle control unit includes a digital radio frequency (RF) decoder chip that receives control signals from a remote transmitter. The micro-processor keeps track of the positions of all components of the transformable toy vehicle 10, namely main body 12, the legs 14, 16 and the arms 18, 20, and coordinates the transforming motions based on the control signals received from the remote transmitter.

Preferably, the control signals from the remote transmitter are transmitted by electro-magnetic frequencies, such as radio frequency (RF), or infrared (IR), but one will appreciate that sound frequencies such as ultra sound, or voice commands could be used, or any other suitable method for transmitting remote control signals. The vehicle control unit may also consist of a pre programmed flying control, or programmable flying control to be programmed by the user.

A remote control unit (not shown) including the remote transmitter, may preferably be used by an operator to control the transformable toy vehicle 10. The remote control unit will have throttle controls for controlling the power to both inner and outer drive shaft motors, and left/right and forward/backwards controls for steering while in the flying and driving modes. The remote control unit will have controls for rotating the arms 14, 16 from a standing position (FIGS. 1 to 5) to a landing/takeoff and flying position (FIGS. 6 to 15) and then to a driving position (FIGS. 16 to 20). The remote control unit will have controls for rotating main body 12 forward into a takeoff/landing position and then back into a standing position and for rotating legs 14, 16 to a flying position and to a driving position. The remote control unit will also have controls for spreading legs 14, 16 apart when in standing mode, landing/takeoff mode and driving mode, and for moving legs 14, 16 together when in flying mode.

Figure 2:
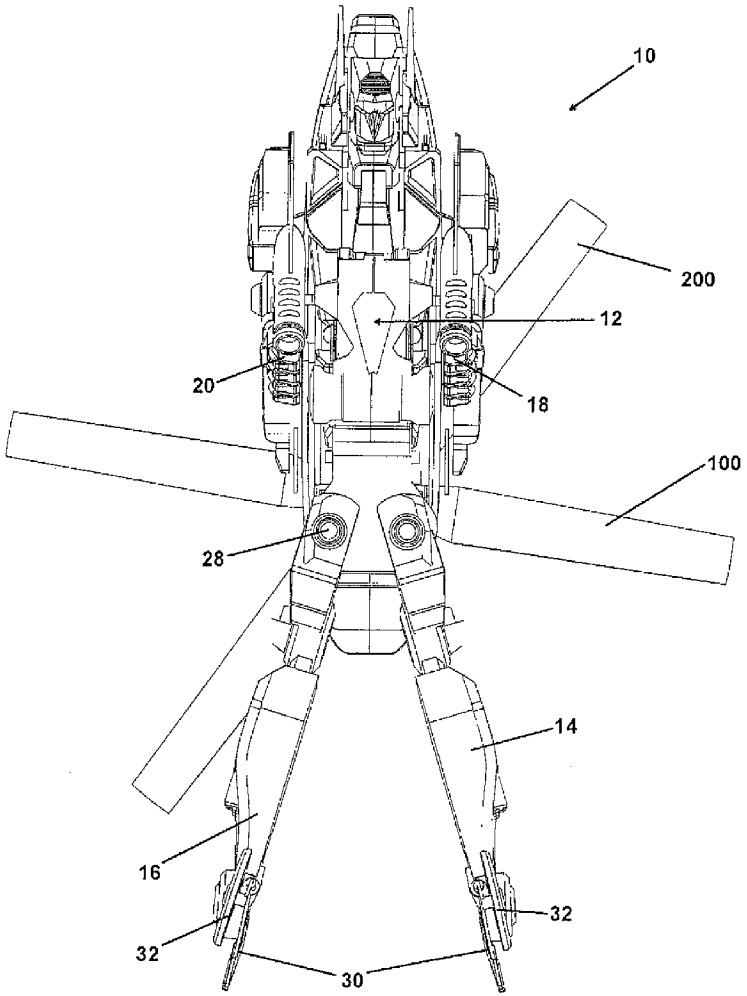
FIG. 2 is a front view of the transformable toy vehicle in a standing position.
Figure 3:
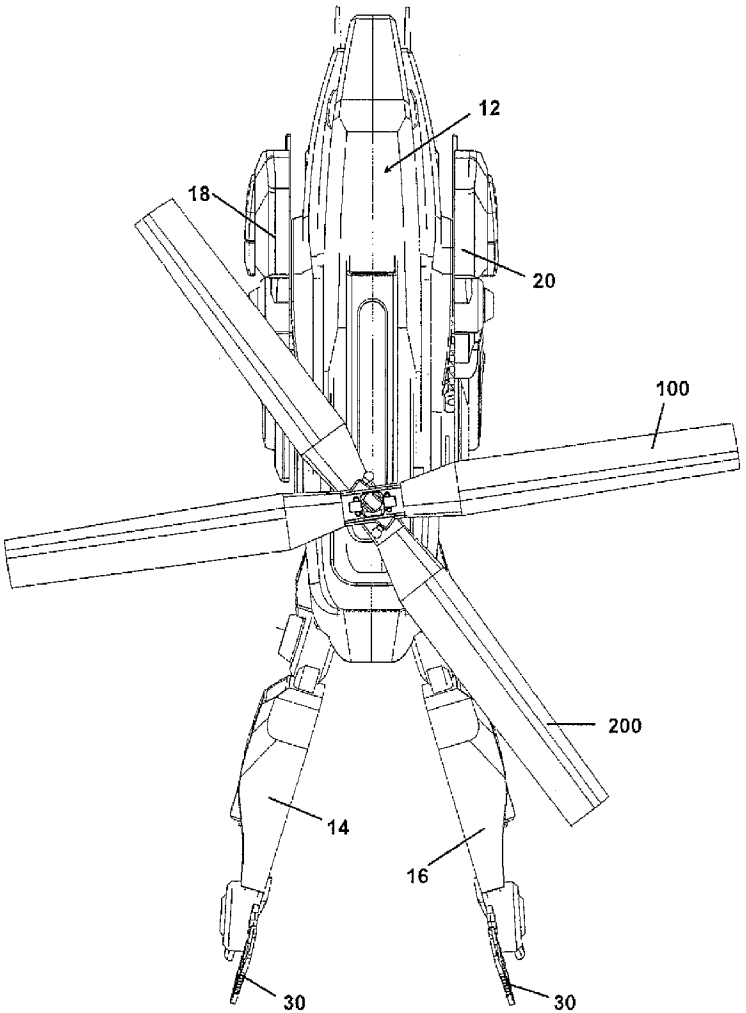
FIG. 3 is a rear view of the transformable toy vehicle in a standing position.
Figure 4:
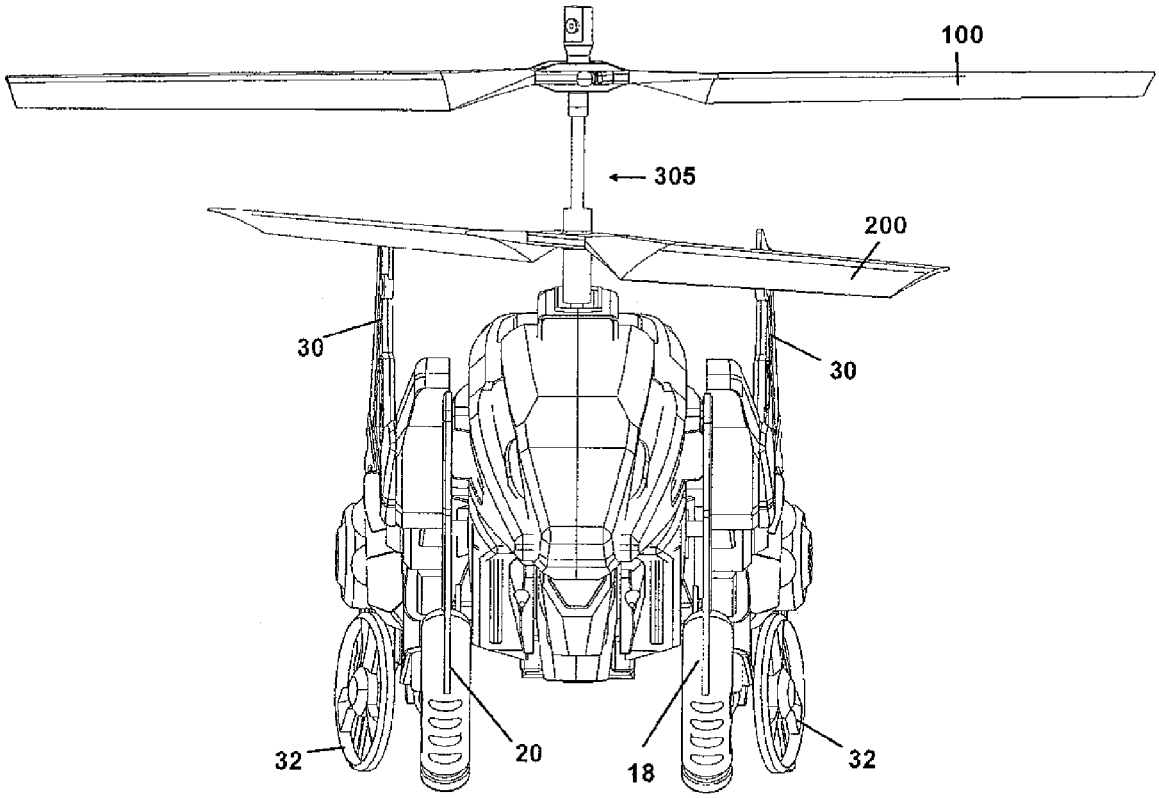
FIG. 4 is a top-down view of the transformable toy vehicle in a standing position.
Figure 5:
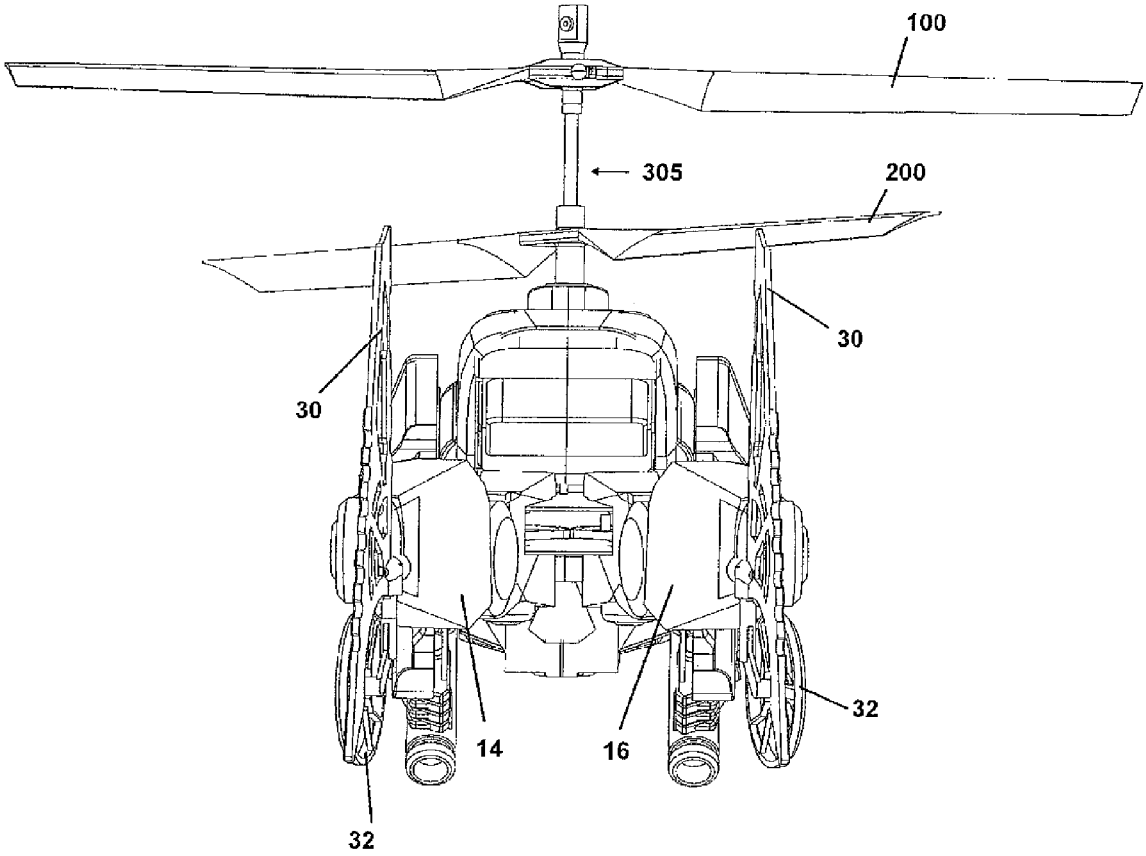
FIG. 5 is a bottom-up view of the transformable toy vehicle in a standing position.

In operation, the transformable toy vehicle 10 is first located in an erect standing position, as shown in FIGS. 1 to 5, with the main coaxial drive shaft 305 positioned generally parallel to the ground surface and the upper and lower rotor blades 100, 200 generally parallel with the main body 12 and legs 14, 16. Legs 14, 16 are spread wide apart, as shown in FIGS. 2 and 3, for stability.

To prepare for takeoff, a signal is sent from the remote transmitter to the receiver in the vehicle control unit to rotate the main body 12 forward 90 degrees with respect to legs 14, 16, as shown in FIGS. 6 to 10, into a takeoff position. This motion moves the upper and lower rotor blades 100, 200 generally horizontal to the ground surface allowing the blades to provide positive vertical lift. At the same time, the entire rotating blade system 300 is moved slightly forward on rails 350 by drive gear 360 (this motion is not illustrated in the attached drawings) and arms 18, 20 are rotated back counter-clockwise about 45 degrees into a more aerodynamic position for flying. These movements are precisely calculated and coordinated to provide the transformable toy vehicle 10 with the proper center of gravity for stable flight.

To take off, the throttle control on the remote control unit is advanced forward and the transformable toy vehicle 10 lifts off the ground when the speed of the rotor blades 100, 200 is sufficient to provide the necessary lift. Increasing the throttle will increase the altitude. Steering is accomplished by adjusting the left/right and forward/backwards controls on the remote control unit, which causes the upper and lower counter-rotating blades 100, 200 to be driven at different relative speeds.

Figure 7:
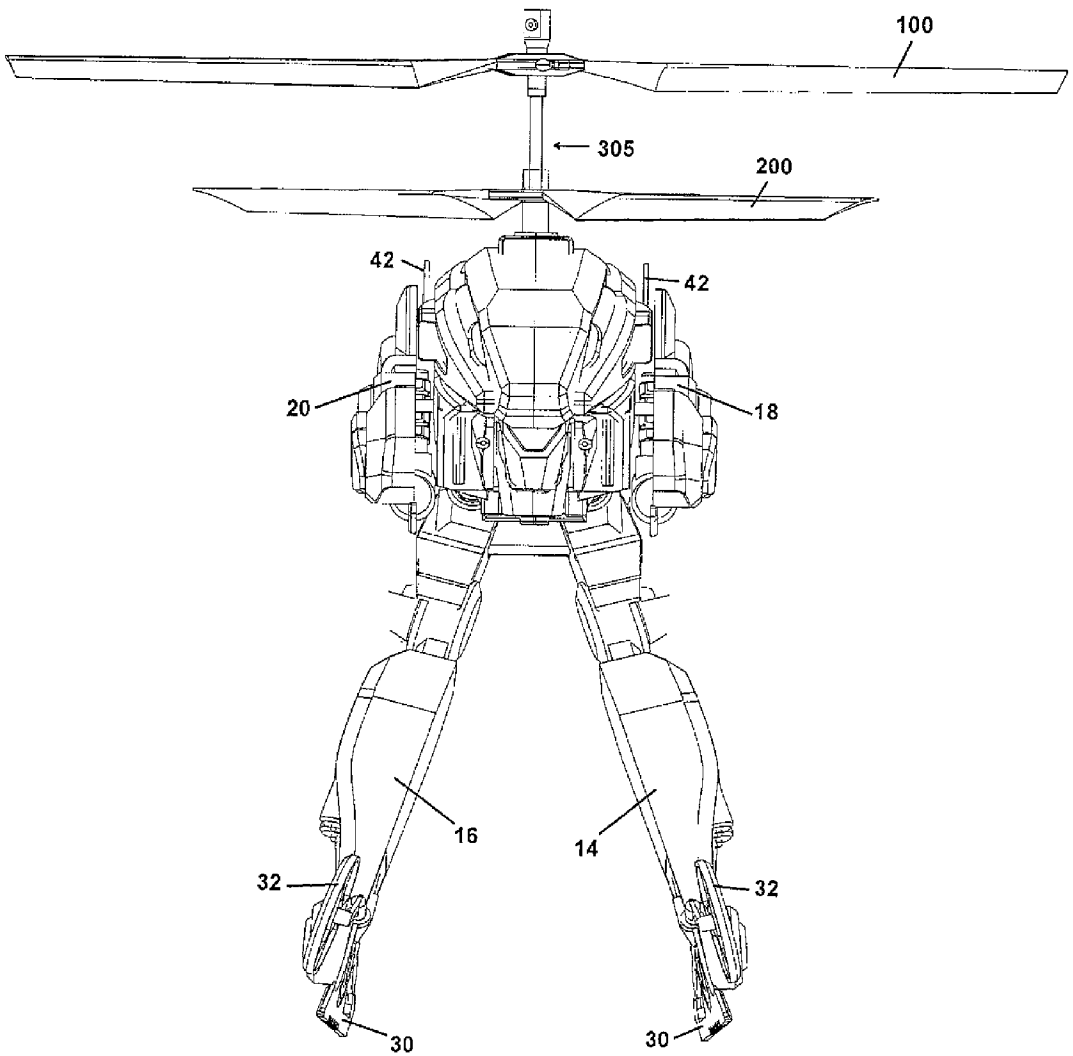
FIG. 7 is a front view of the transformable toy vehicle in a takeoff/landing position.
Figure 8:
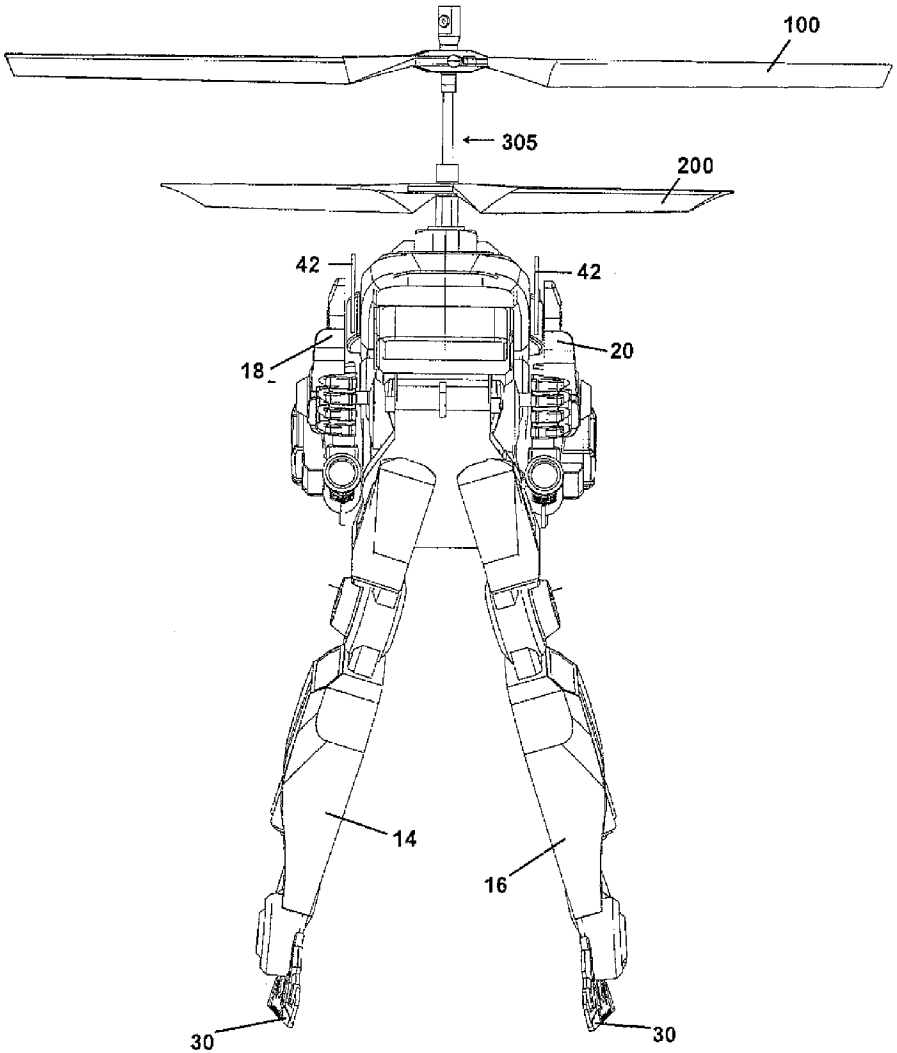
FIG. 8 is a rear view of the transformable toy vehicle in a takeoff/landing position.
Figure 9:
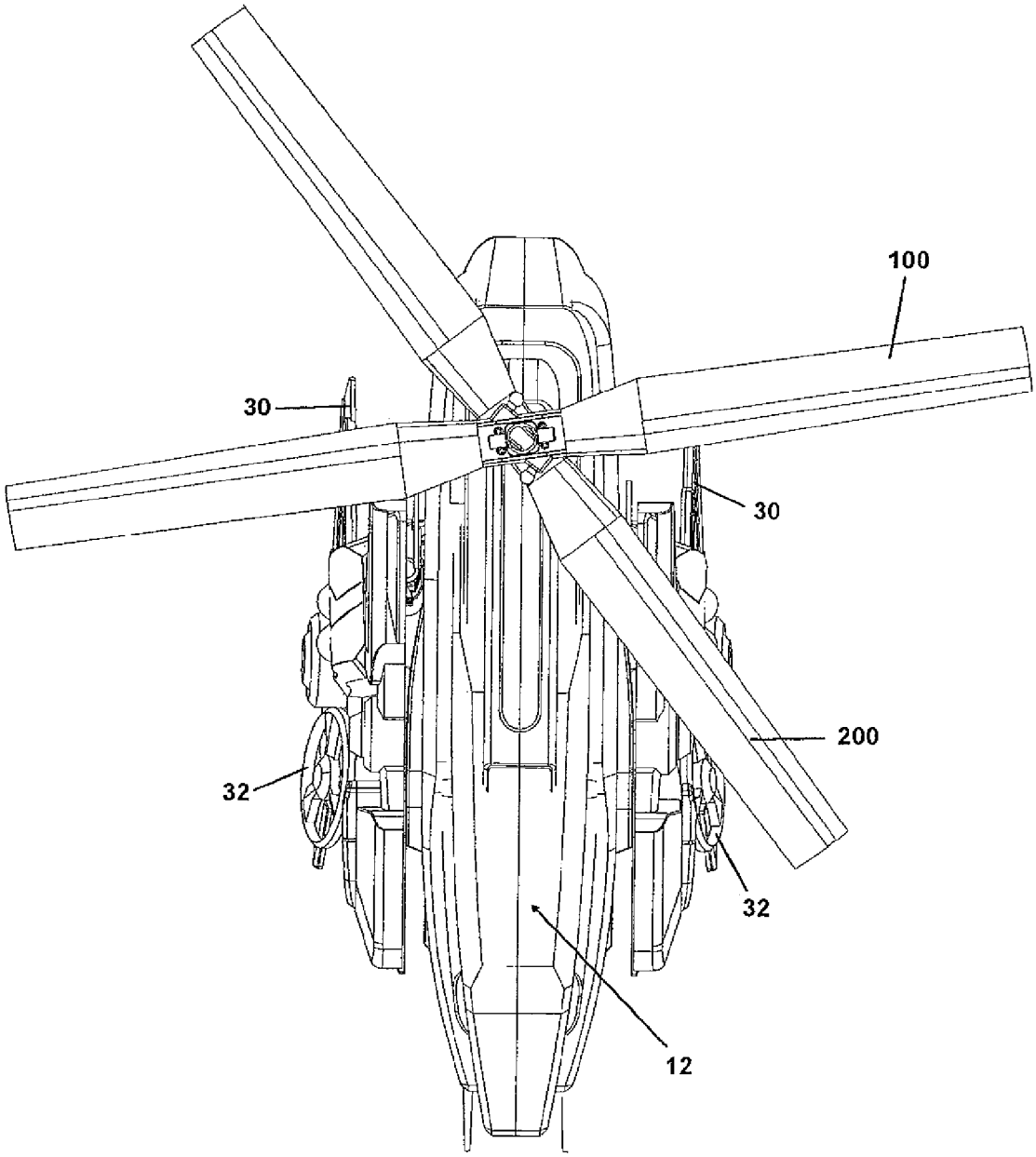
FIG. 9 is a top-down view of the transformable toy vehicle in a takeoff/landing position.
Figure 10:
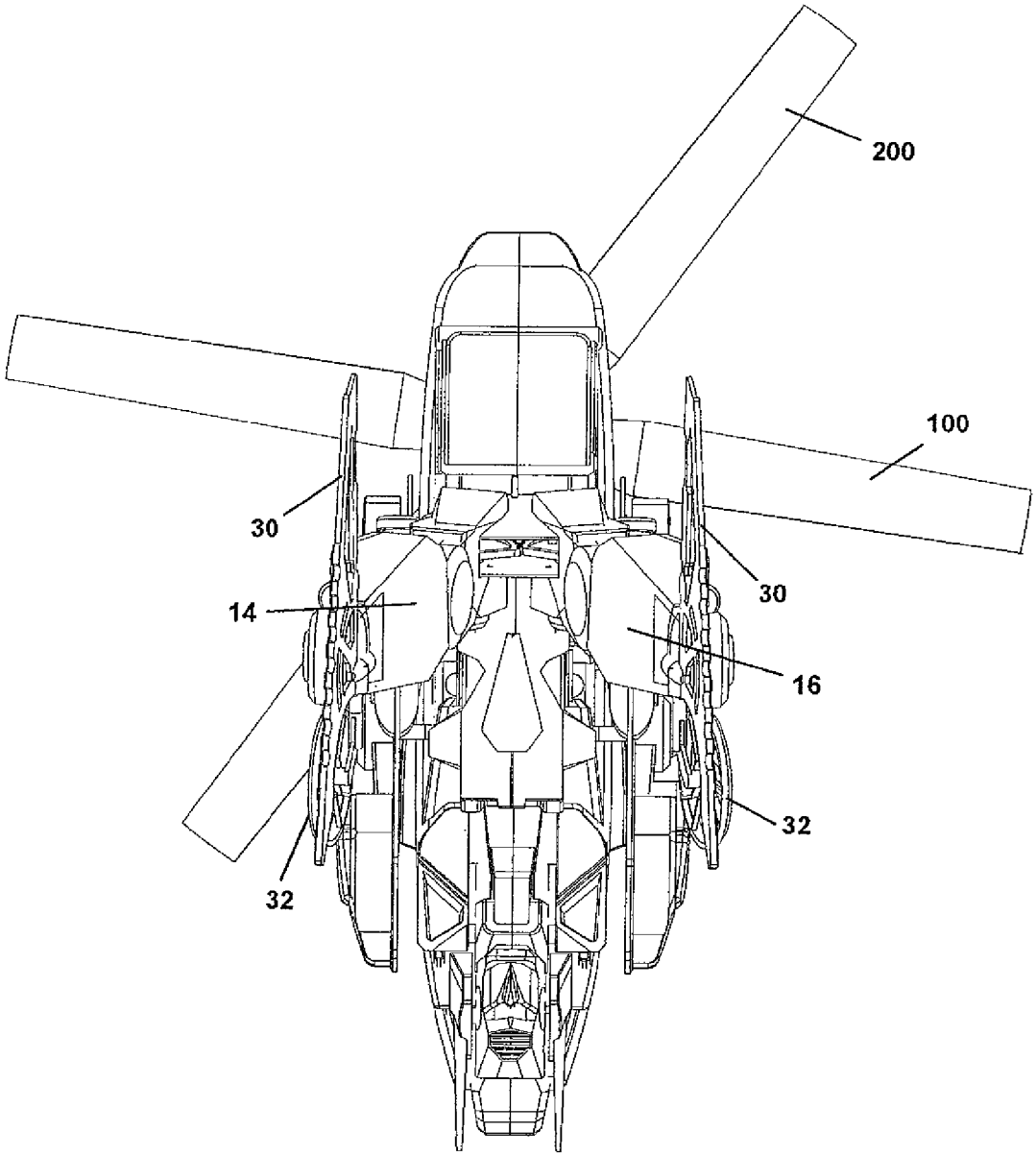
FIG. 10 is a bottom-up view of the transformable toy vehicle in a takeoff/landing position.
Figure 11:
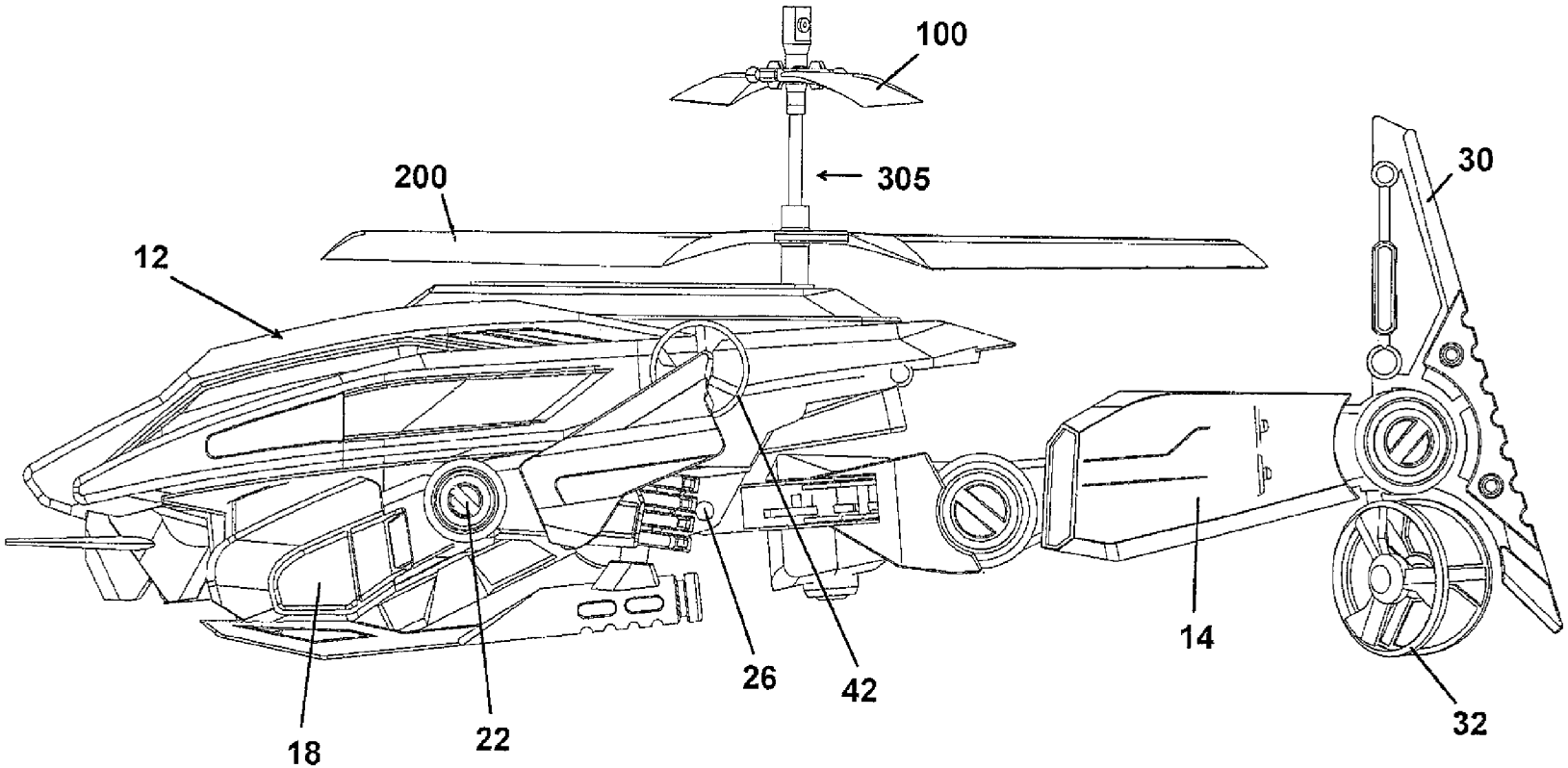
FIG. 11 is a left side view of the transformable toy vehicle in a flying position.
Figure 12:
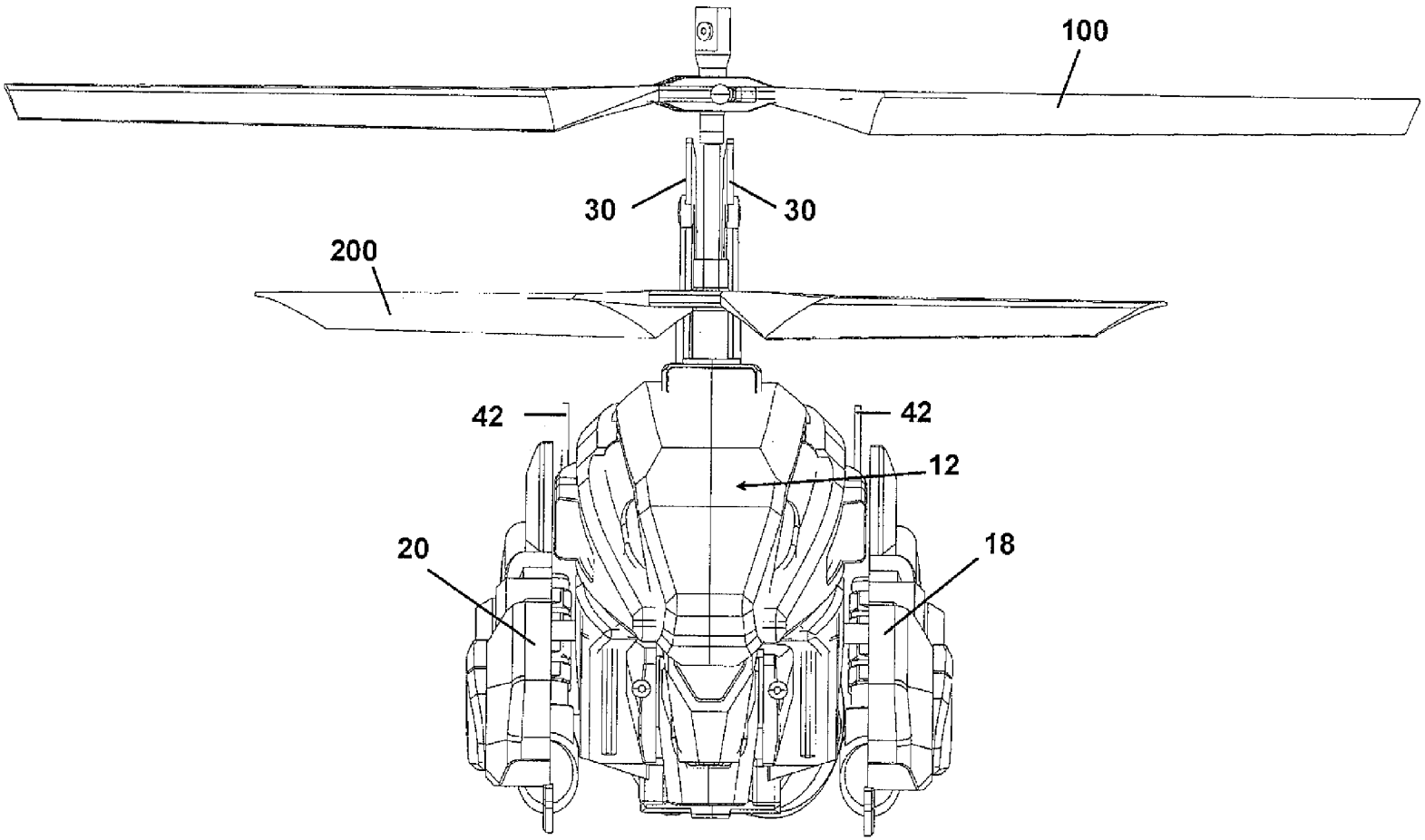
FIG. 12 is a front view of the transformable toy vehicle in a flying position.
Figure 13:
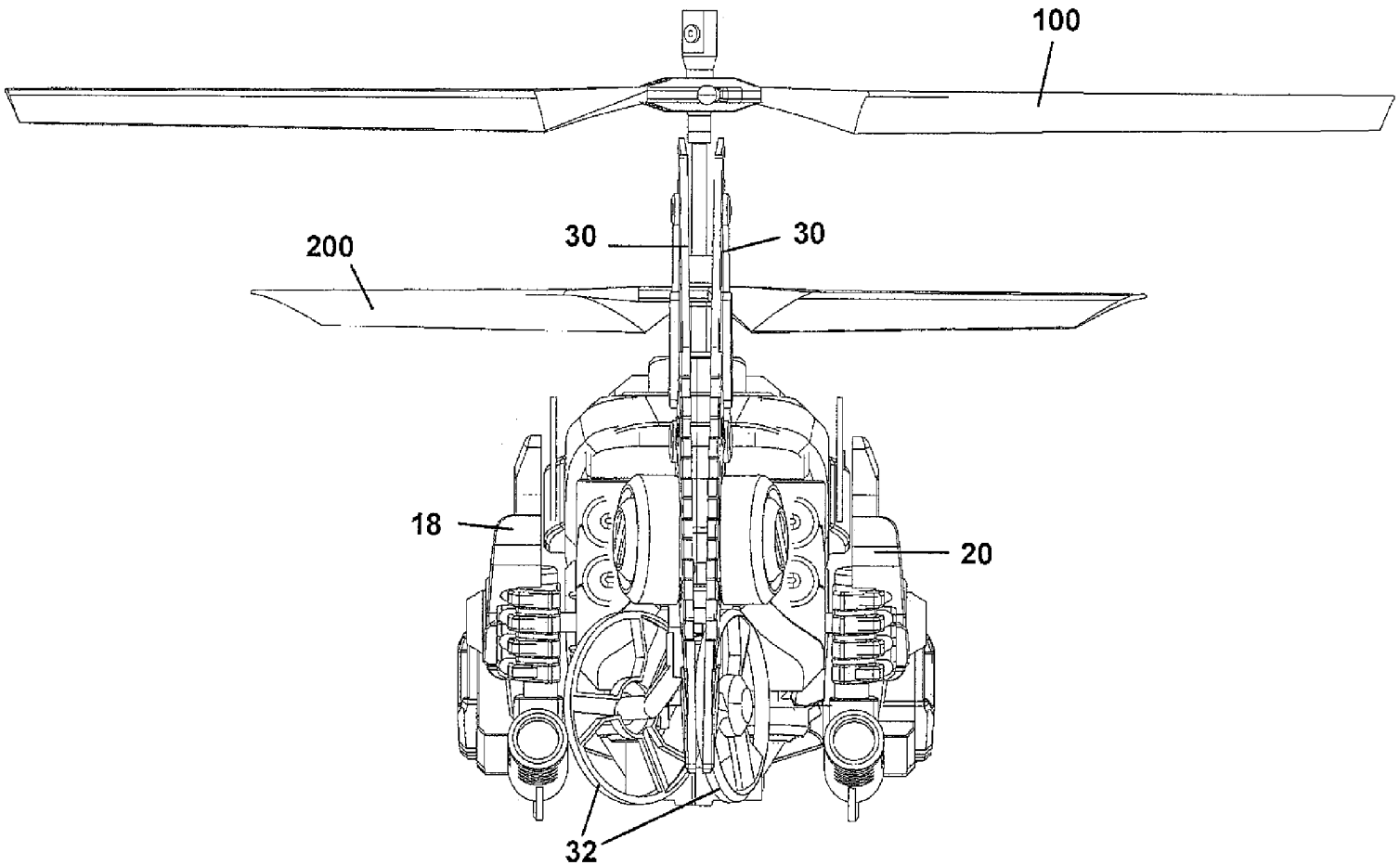
FIG. 13 is a rear view of the transformable toy vehicle in a flying position.
Figure 14:
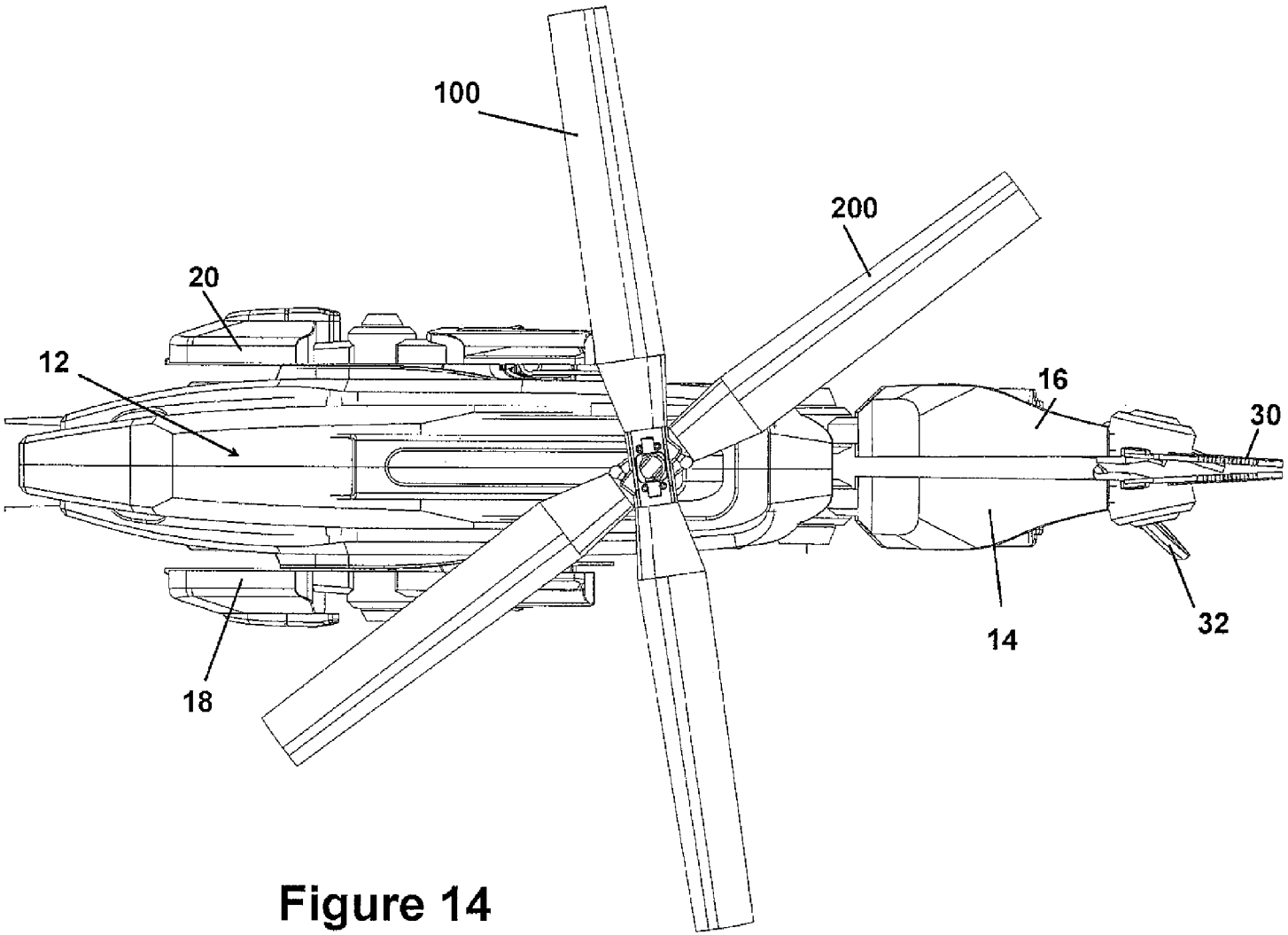
FIG. 14 is a top-down view of the transformable toy vehicle in a flying position.
Figure 15:
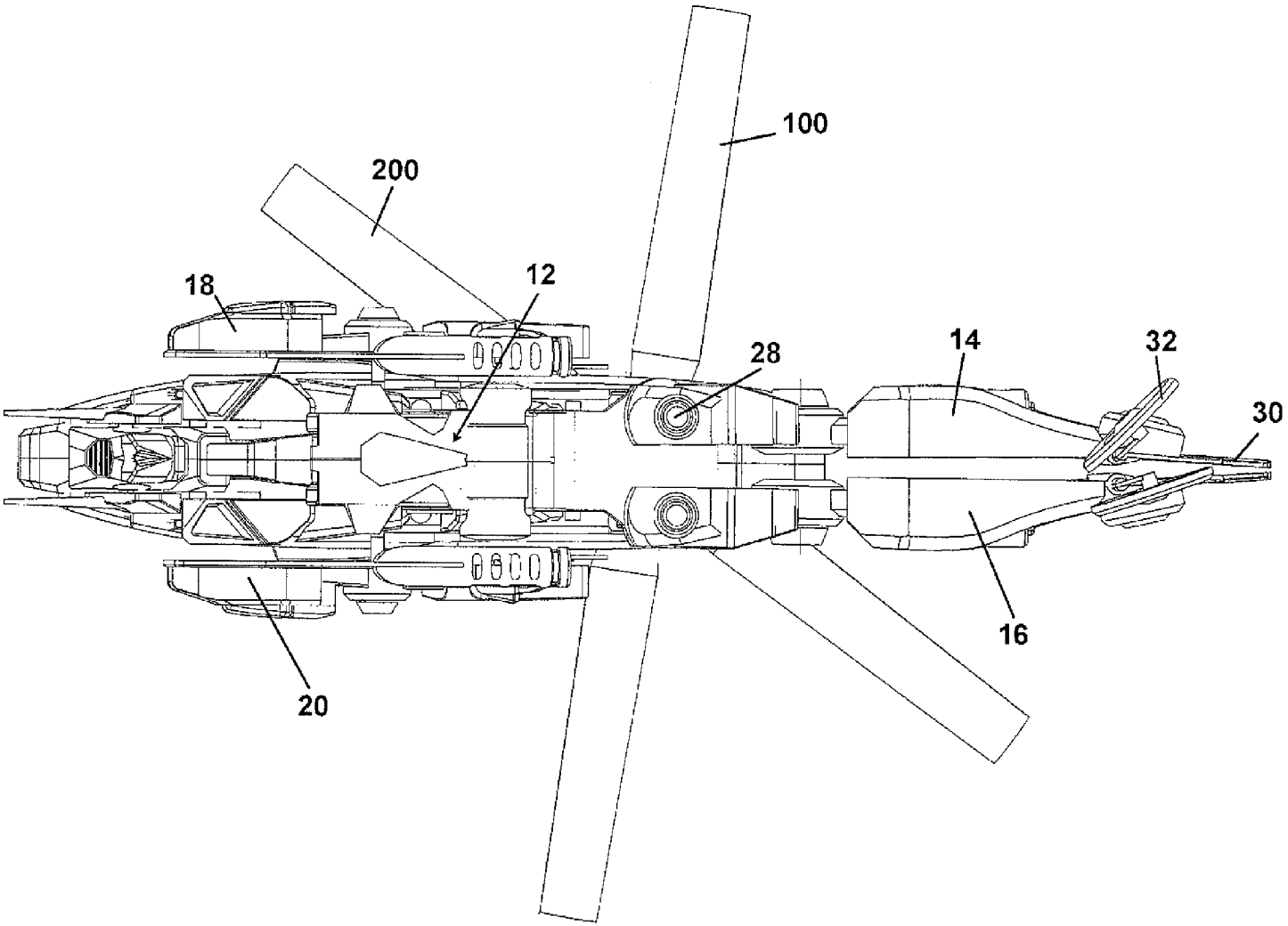
FIG. 15 is a bottom-up view of the transformable toy vehicle in a flying position.

Once air born, a signal may be sent from the remote control unit to cause legs 14, 16 to rotate to a horizontal position as shown in FIGS. 11 to 16, parallel with the main body 12. The legs 14, 16 are also drawn together from a spread-wide position as shown in FIG. 7, to a drawn-together position as shown in FIGS. 14 and 15. To accommodate the shift in center of gravity caused by these movements, the entire rotating blade system 300 is moved forward on main body 12 by drive gear 360 (this motion is not illustrated in the attached drawings). These movements are all driven and timed by a set of grooved cam plates 24, gears, and an indexing wheel, all driven by a servo motor or motors. The micro-processor of the vehicle control unit links and coordinates the movements so that the optimal center of gravity is at all times maintained for proper, stable flight. Alternatively, in place of the indexing wheel, a hexadecimal 16 position switch may be used to perform the same function.

Figure 16:
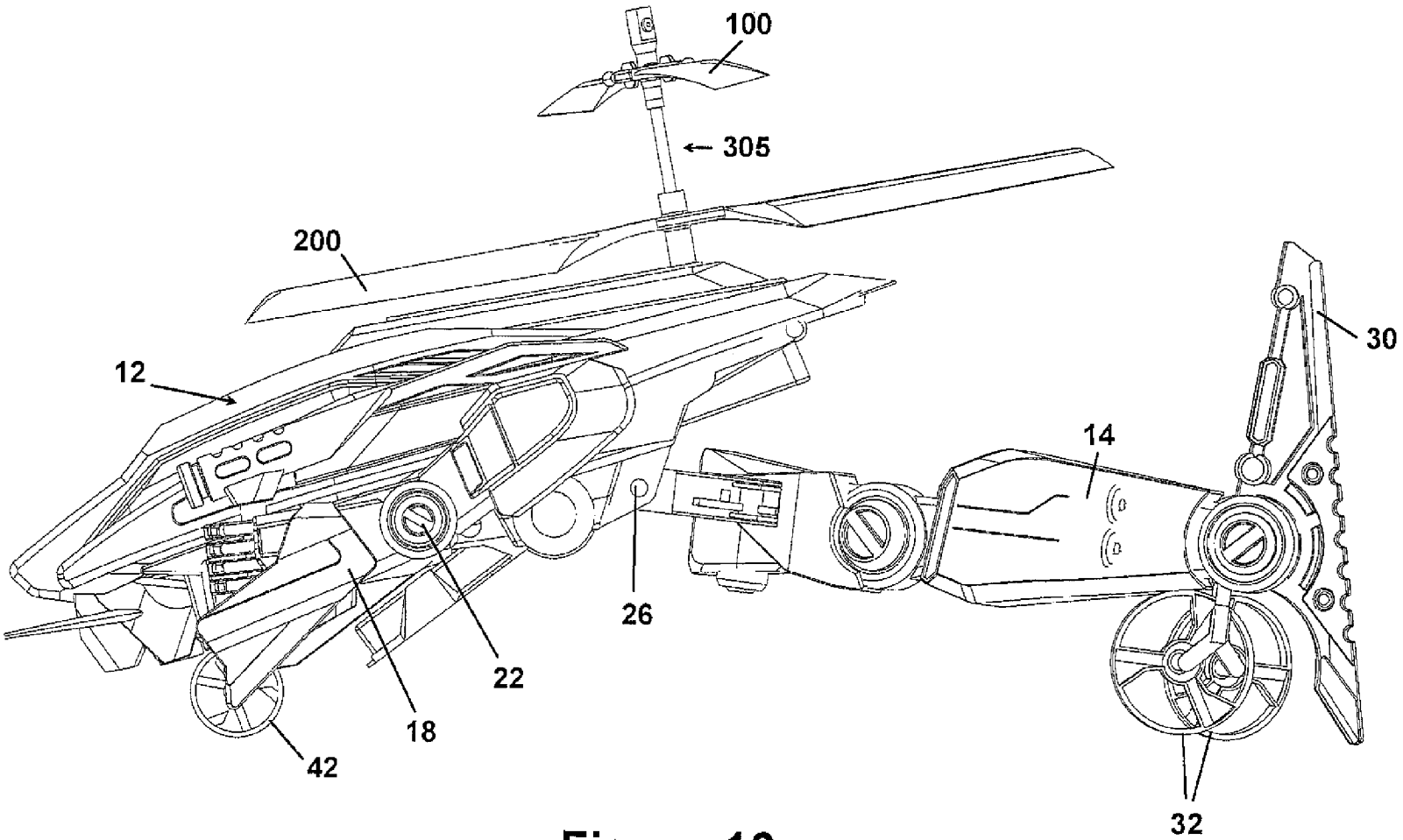
FIG. 16 is a left side view of the transformable toy vehicle in a driving position.
Figure 17:
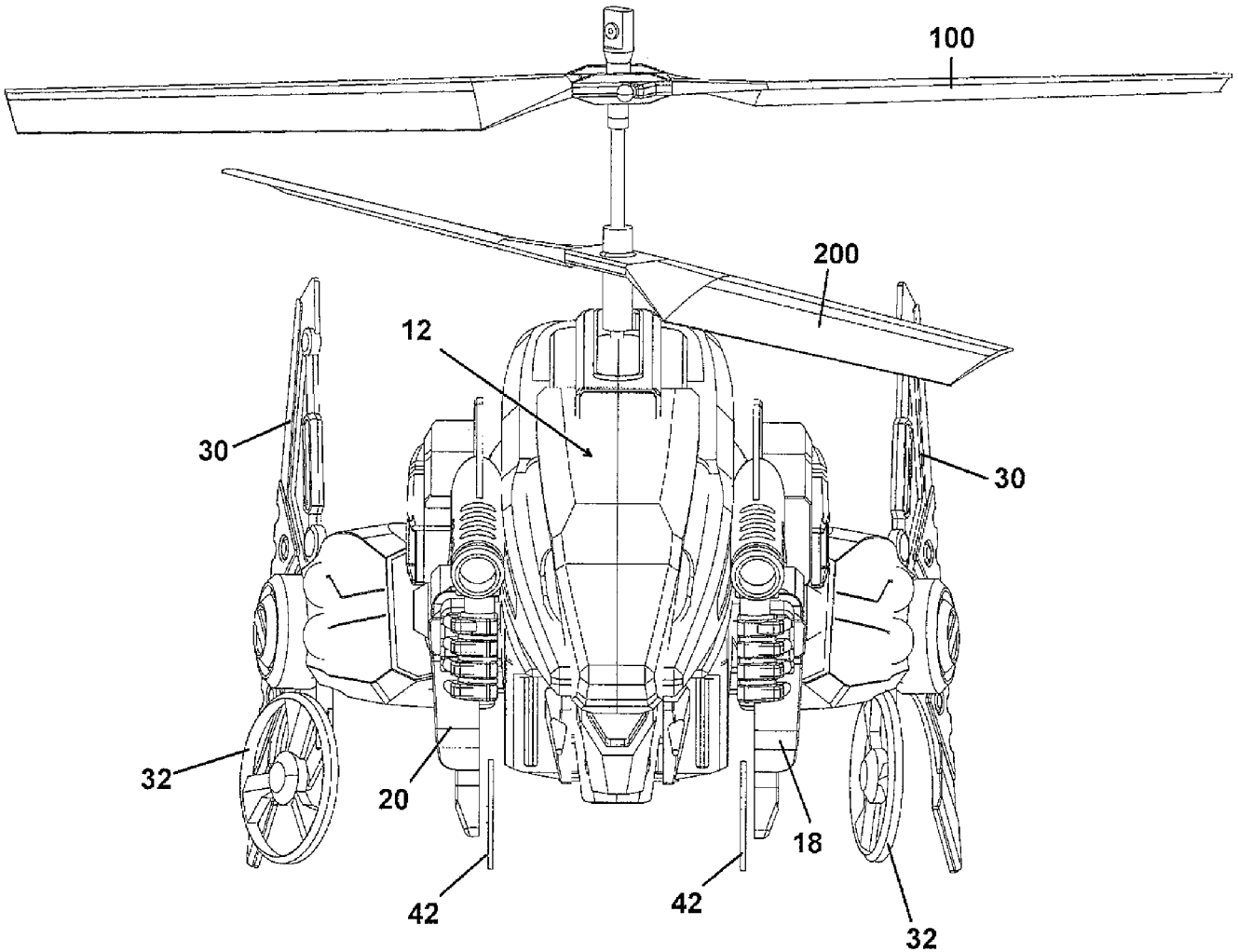
FIG. 17 is a front view of the transformable toy vehicle in a driving position.
Figure 18:
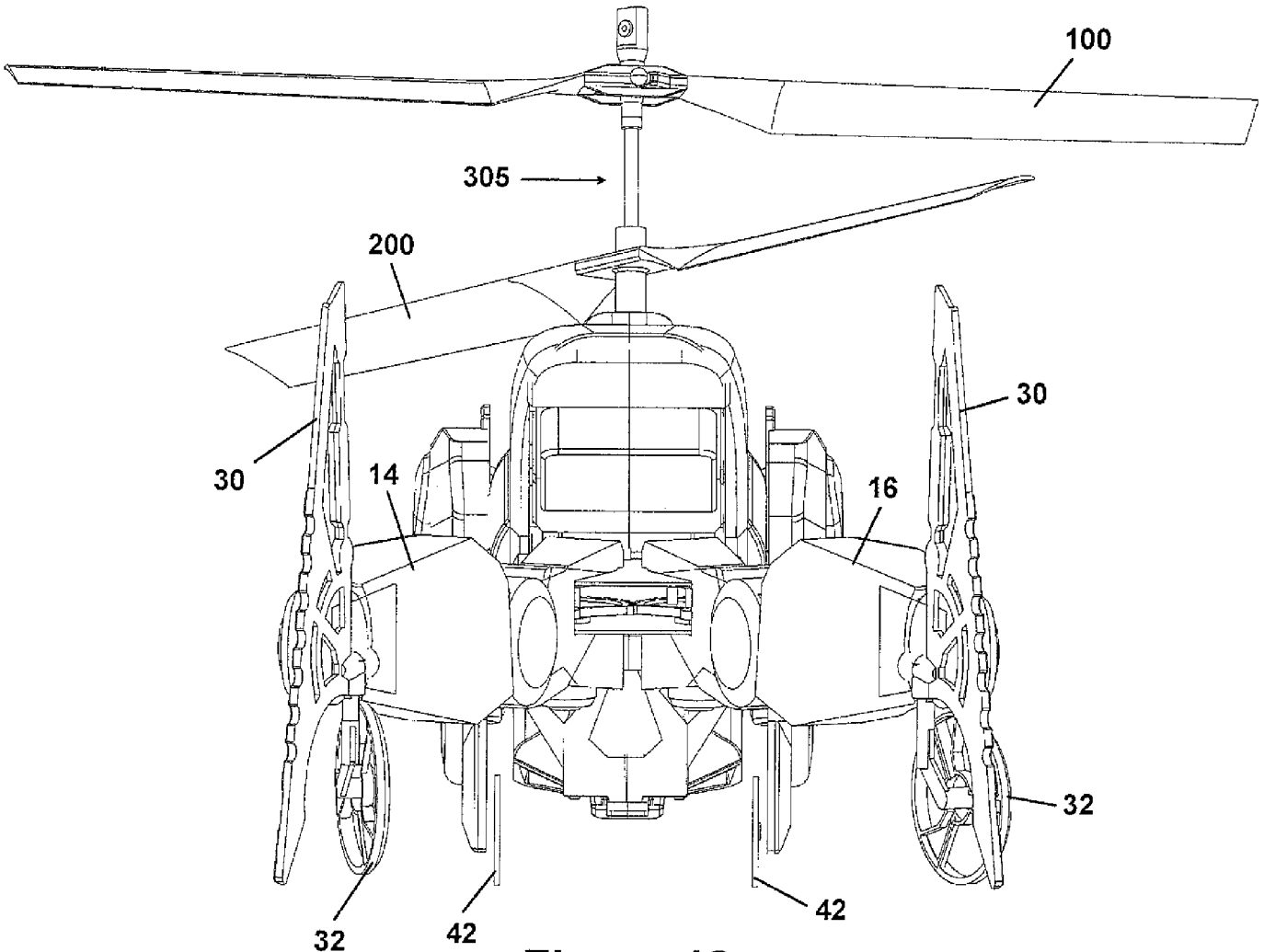
FIG. 18 is a rear view of the transformable toy vehicle in a driving position.
Figure 19:
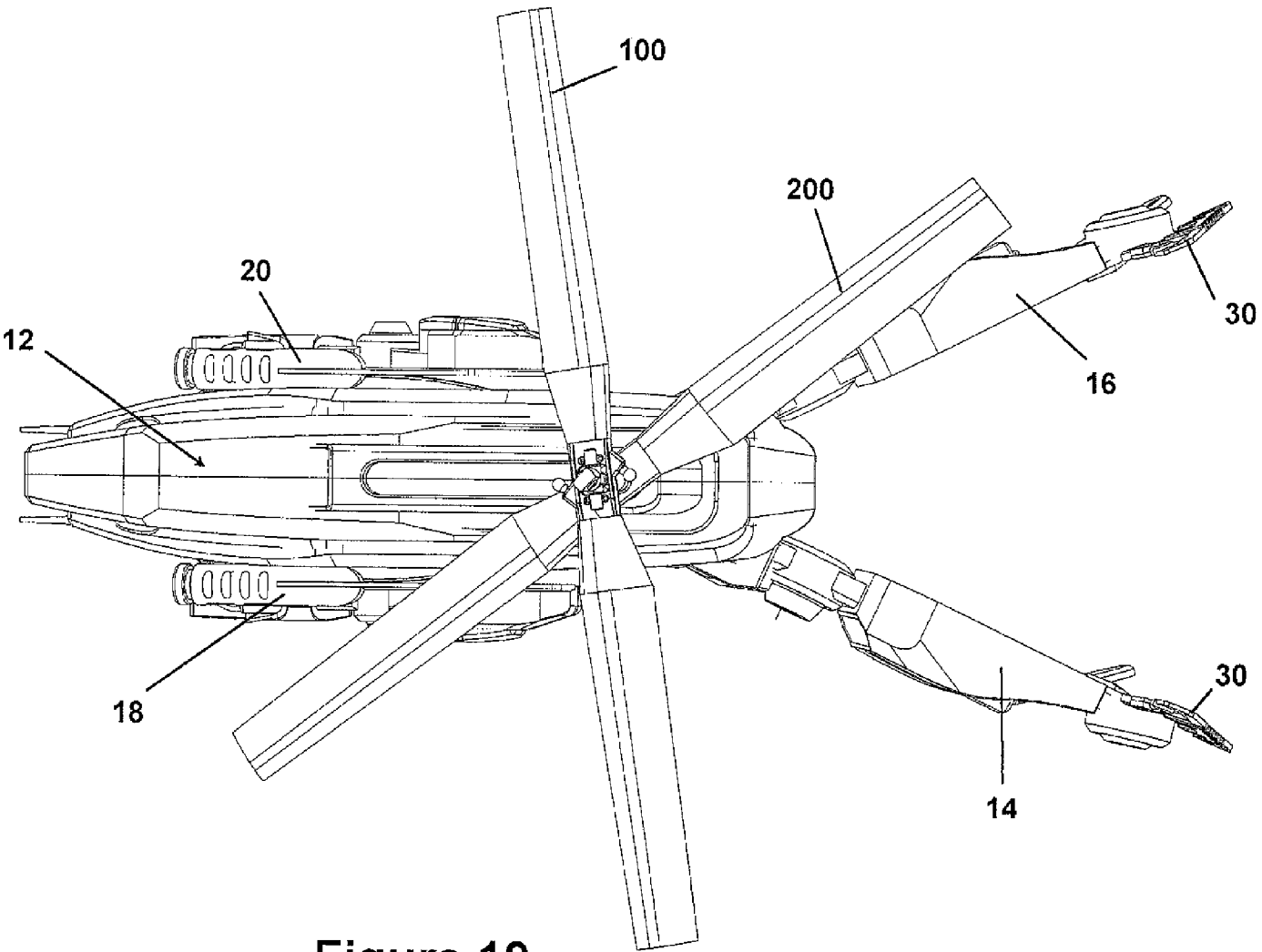
FIG. 19 is a top-down view of the transformable toy vehicle in a driving position.
Figure 20:
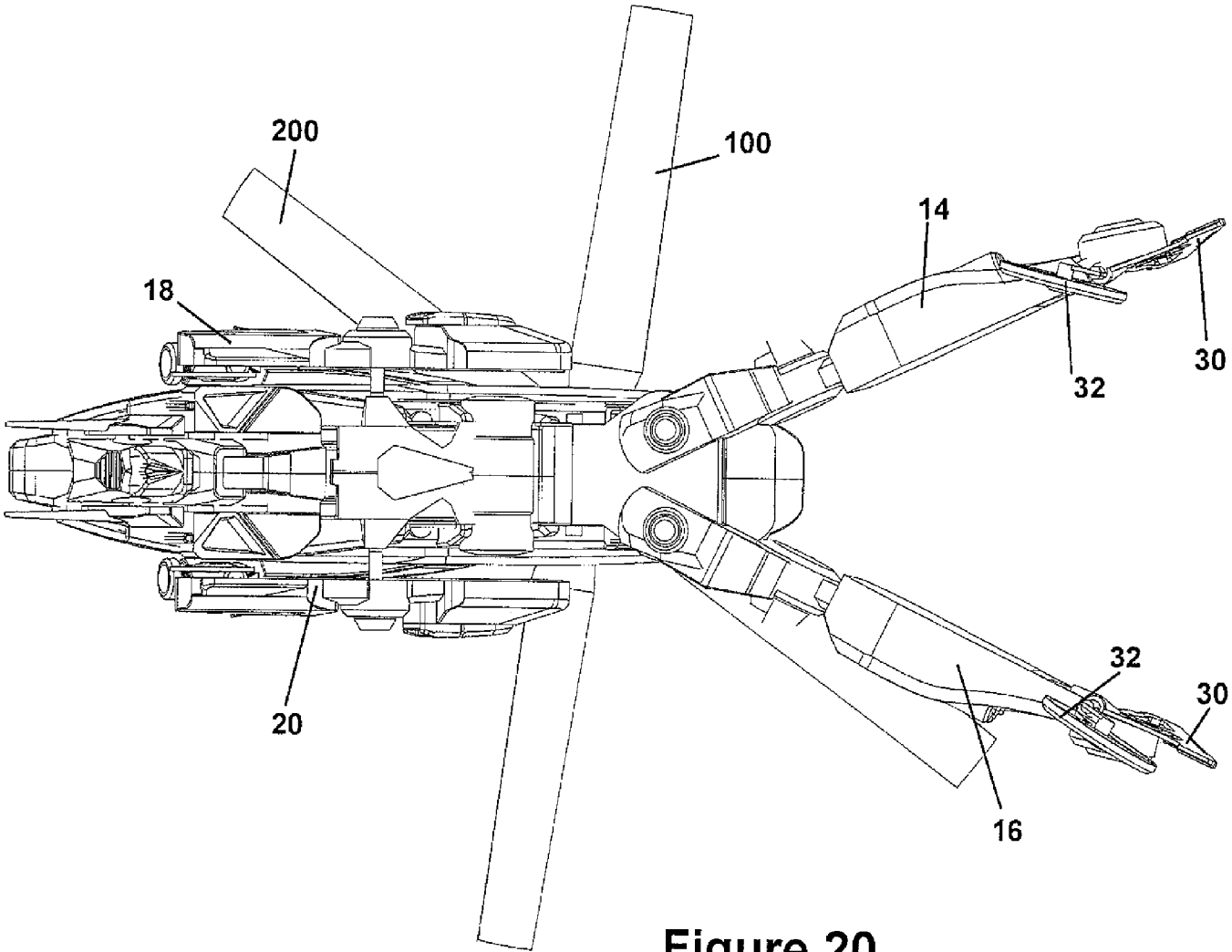
FIG. 20 is a bottom-up view of the transformable toy vehicle in a driving position.
Figure 21:
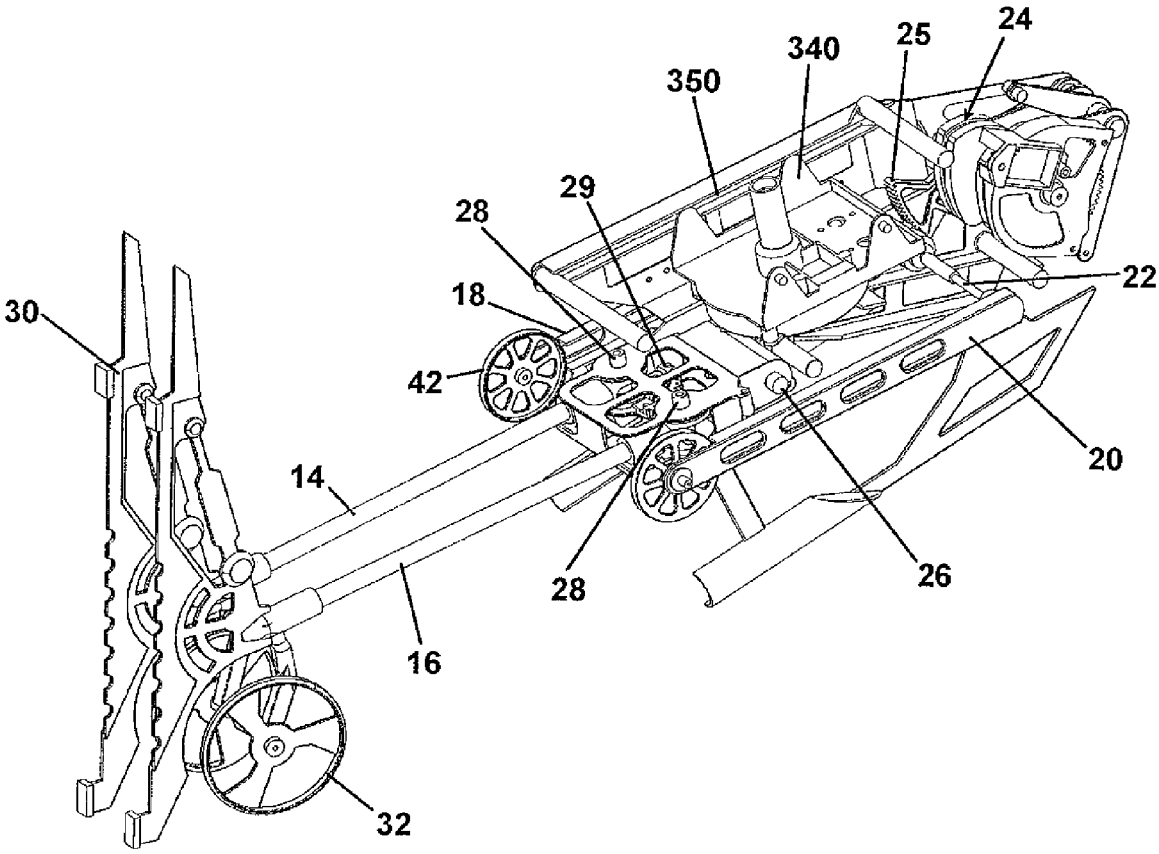
FIG. 21 is a right side perspective, cut-away, partial interior view of the transformable toy vehicle in the flying position with the shell coverings removed.

During flight, and in preparation for landing, a command may be sent from the remote control unit to the vehicle control unit to rotate arms 18 and 20 in a clockwise direction to a position as shown in FIG. 16, in which wheels 42 are positioned downward for engagement with the surface. At the same time, main body 12 is rotated slight forward with respect to legs 14, 16, and legs 14, 16 are spread apart as shown in FIGS. 19 and 20. The position of the rotating blade system 300 is adjusted as necessary to maintain the proper center of gravity for stable flight (this motion is not illustrated in the attached drawings). When power to the throttle is reduced, the altitude of the transformable toy vehicle 10 drops sufficiently so that wheels 32 and 42 engage gently with the ground surface and the transformable toy vehicle 10 can be driven over the surface like a wheeled vehicle. While in the driving position, as shown in FIGS. 16 to 20, the transformable toy vehicle 10 can be steered by differentially controlling the relative speeds of the two counter-rotating coaxial drive shafts 310 and 312, controlled by signals from the remote control unit using left/right steering controls. A forward bias of the blades 100, 200 provides the forward thrust.

Figure 6:
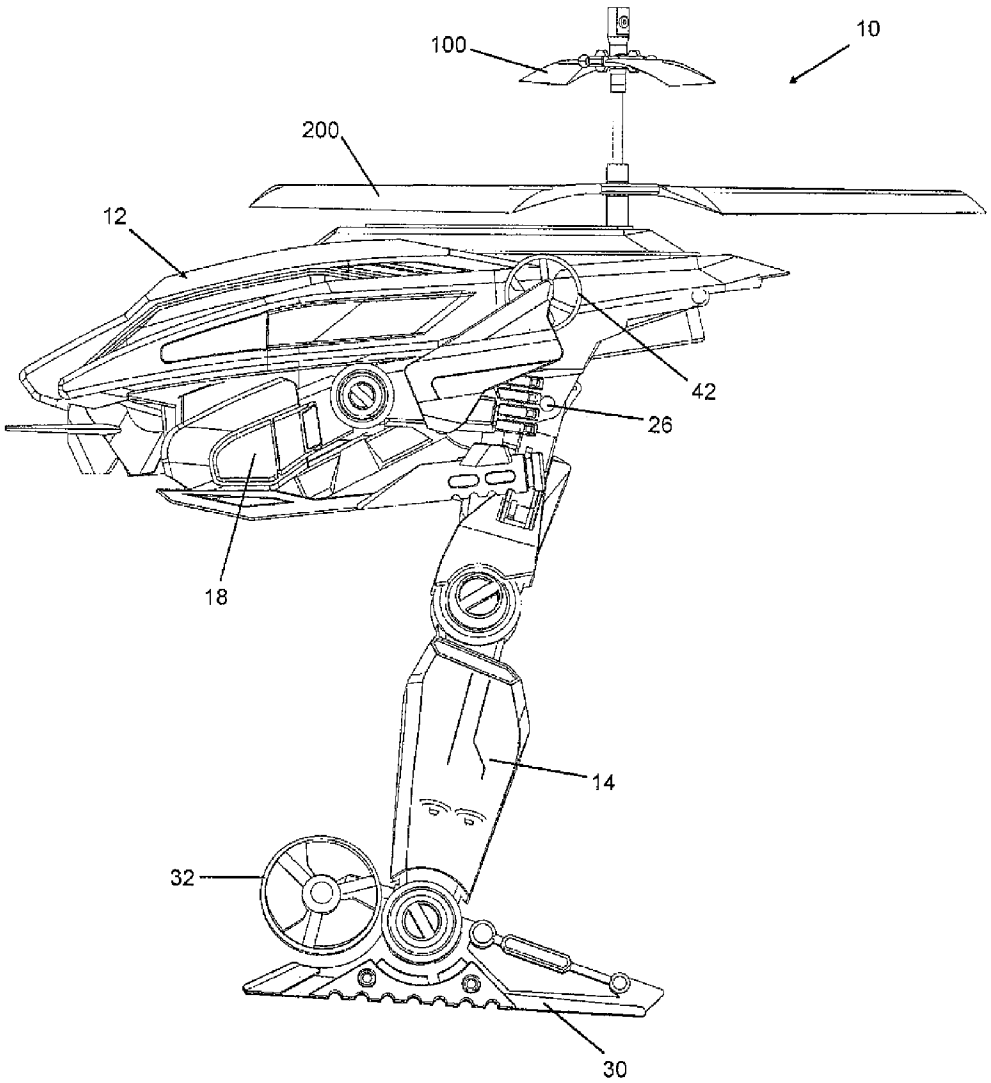
FIG. 6 is a left side view of the transformable toy vehicle in a takeoff/landing position.

To return the transformable toy vehicle 10 to the standing position as shown in FIG. 1, the rotational speed of blades 100 and 200 is increased sufficiently to lift the transformable toy vehicle 10 off the ground and to a sufficient height, whereupon legs 14, 16 are rotated downward to a position 90 degrees with respect to main body 12 as shown in FIG. 6. At the same time, arms 18, 20 are rotated counterclockwise back into the position shown in FIG. 6, the position of the rotating blade system 300 is adjusted as necessary to maintain the proper center of gravity for stable flight, and throttle speed is reduced so that altitude drops and the transformable toy vehicle 10 contacts the ground surface, landing on its feet 30. Main body 12 is then rotated back 90 degrees to a vertical standing position parallel with legs 14, 16 and arms 18, 20 are rotated clockwise about 45 degrees back to the position shown in FIG. 1.

Figure 24:
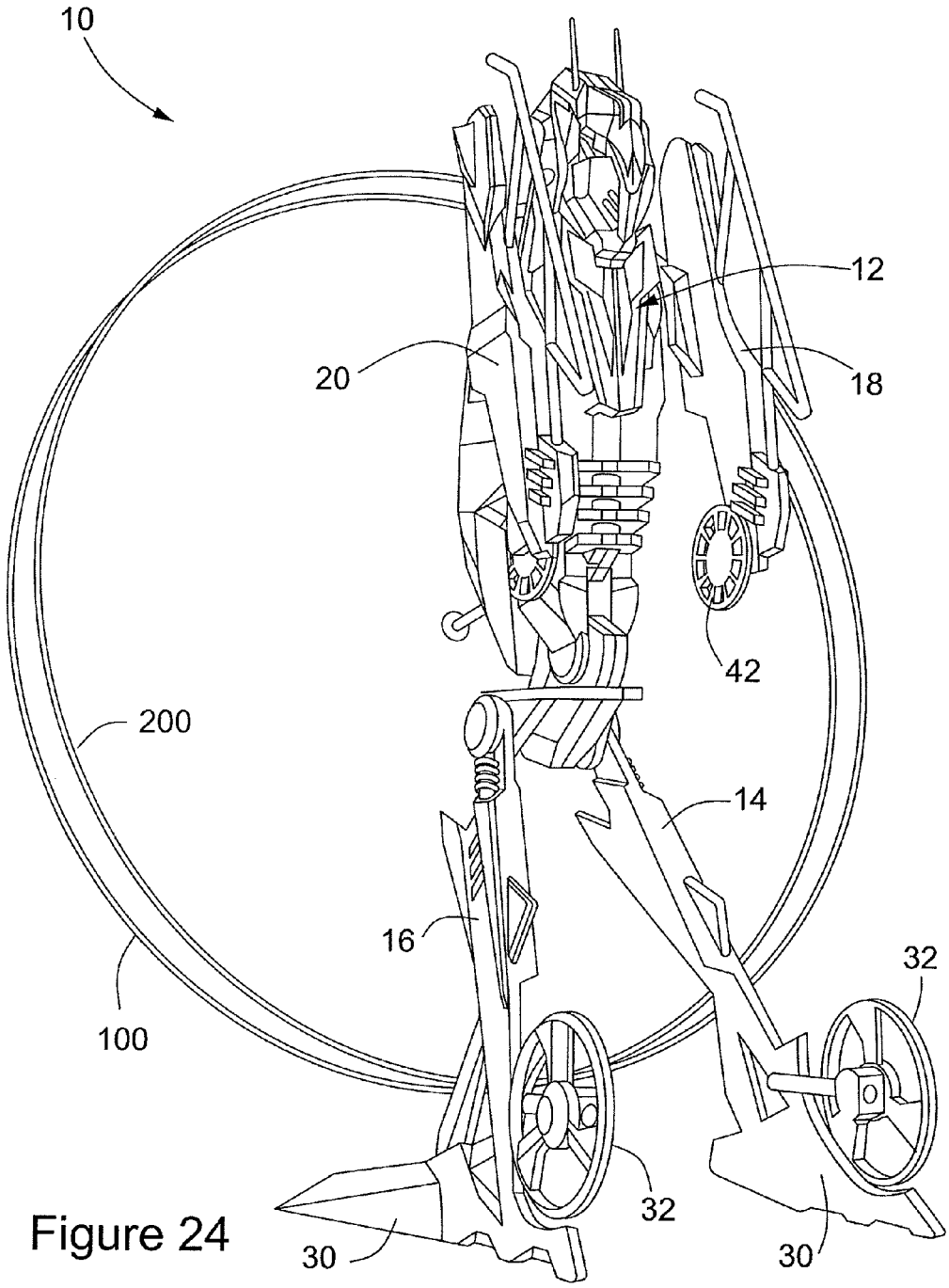
FIG. 24 is a right side perspective view of an alternate version of the transformable toy vehicle in a standing position, showing the rotor blades in schematic form.
Figure 25:
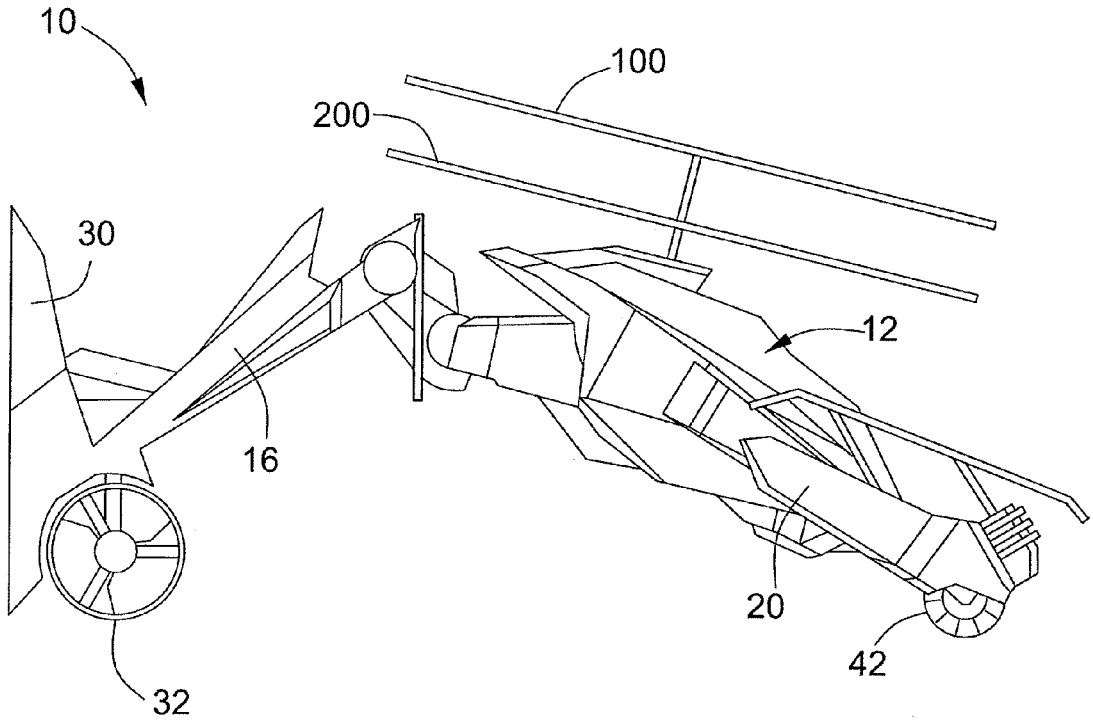
FIG. 25 is a right side view of the alternate version of the transformable toy vehicle shown in FIG. 24, in a driving position.

An outer shell 60, comprising various segments, may cover the internal parts of the transformable toy vehicle 10. The outer shell 60 may be designed to give the transformable toy vehicle 10 the appearance of a machine, such as a robot (see FIGS. 1-20) or an automobile, or a creature, such as an insect (see FIGS. 24 and 25).

One of the main advantages of the present transformable toy vehicle 10 is the ability to dynamically transform from a standing mode, to a flying mode, and then to a driving mode and back again, all while balancing all in-flight forces and maintaining the correct center of gravity for stable flight, takeoff and landing. A further advantage is that the transformations from one mode to another are accomplished automatically by remote control signals and can be done while the transformable toy vehicle 10 is in flight. Another advantage is that the transformable toy vehicle 10 can land in any one of at least two modes/positions. The first, is on legs 14, 16 in the landing/takeoff position as shown in FIGS. 6 to 10, and the second is on both legs 14, 16 and arms 18, 20 in the driving position as shown in FIGS. 16 to 20, wherein the transformable toy vehicle 10 is then immediately operable as a wheeled vehicle. Another advantage is the ability to steer the transformable toy vehicle 10, both in the air and on the ground, by differentially driving blades 100, 200 at different relative speeds.

In at least another embodiment, the present invention provides a a toy vehicle having a vehicle body and a support system attached to the vehicle body which supports the vehicle body for movement in contact with a ground surface. In at least one embodiment, the support system for the vehicle body has a suspension system and a plurality of wheels which can engage the ground surface as the toy vehicle is moving over the ground. The suspension system can operate using springs and can have independent suspension for each wheel, or the suspension of two or more of the wheels can be linked. In at least one embodiment, the suspension of the front wheels and the suspension of the rear wheels can each be extended or compressed independently.

This embodiment of the toy vehicle also has a rotating blade system attached to the vehicle body which can act to both drive the toy vehicle over the ground surface and lift the toy vehicle from the ground surface. The rotating blade system is powered by a power source. In at least one embodiment, the rotating blade system includes a first lifting blade, a second lifting blade, a first drive shaft connected to the first lifting blade and driven by a first motor and a second drive shaft connected to the second lifting blade and driven by a second motor. The first drive shaft can be coaxial with the second drive shaft and the first and second motors can drive the first and second drive shafts and lifting blades at two different rotational speeds. In at least one embodiment, the rotating blade system is reversible, such that each of the first and second drive shafts can be driven in either the forward or the reverse directions. In at least one embodiment, the first and second drive shafts are driven in different rotational directions from each other so that the first and second lifting blades rotate in opposite directions from each other. As described above, the counter-rotating movement of the blades acts to cancel angular torque and provide stability.

In at least one embodiment, the toy vehicle has a vehicle control unit as described above so that the support system and the rotating blade system can be controlled by signals sent from a remote control unit. In this way, a user can drive the toy vehicle over the ground by sending a signal from the remote control to the vehicle control unit which directs the application of power to the first and second motors. By activating controls which act to increase power to the rotating blade system, the user can cause the toy vehicle to be lifted from the ground so as, for example, to jump over obstacles or to hover or fly through the air. The toy vehicle can be steered, both on the ground and in flight, by the activation of controls which drive the first and second lifting blades at different speeds. The direction of rotation of the lifting blades can also be reversed by the activation of appropriate controls, allowing the toy vehicle to be driven both forward and in reverse.

Figure 26:
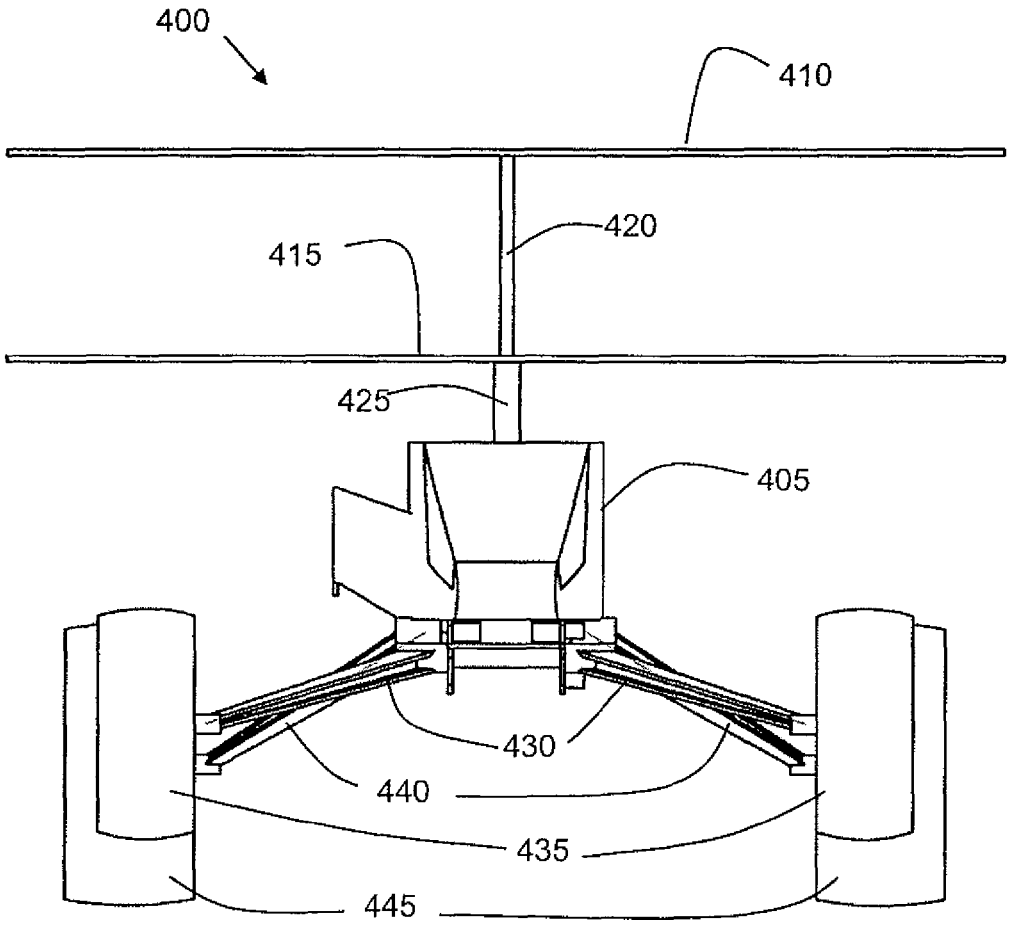
FIG. 26 is a front view of another embodiment of the present toy vehicle in which the rotating blade system is rotating.
Figure 27:
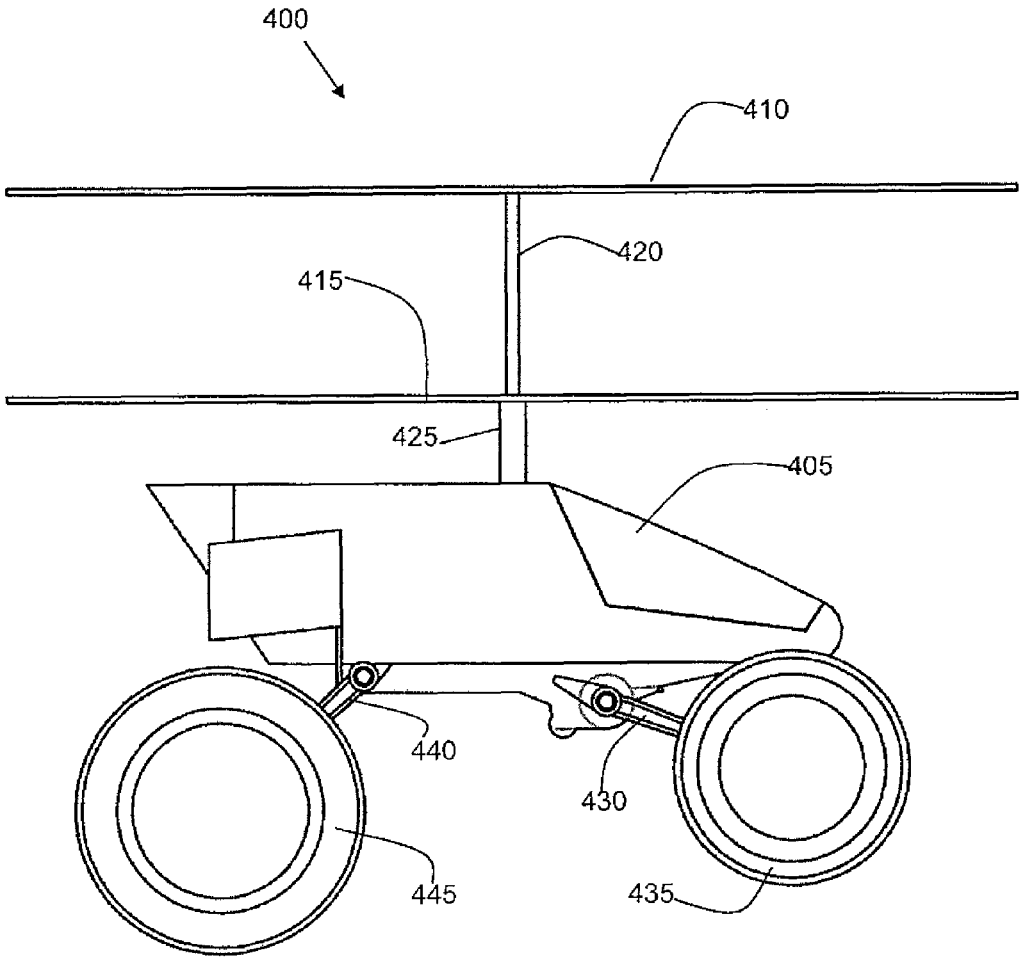
FIG. 27 is a side view of the embodiment of FIG. 26.
Figure 28:
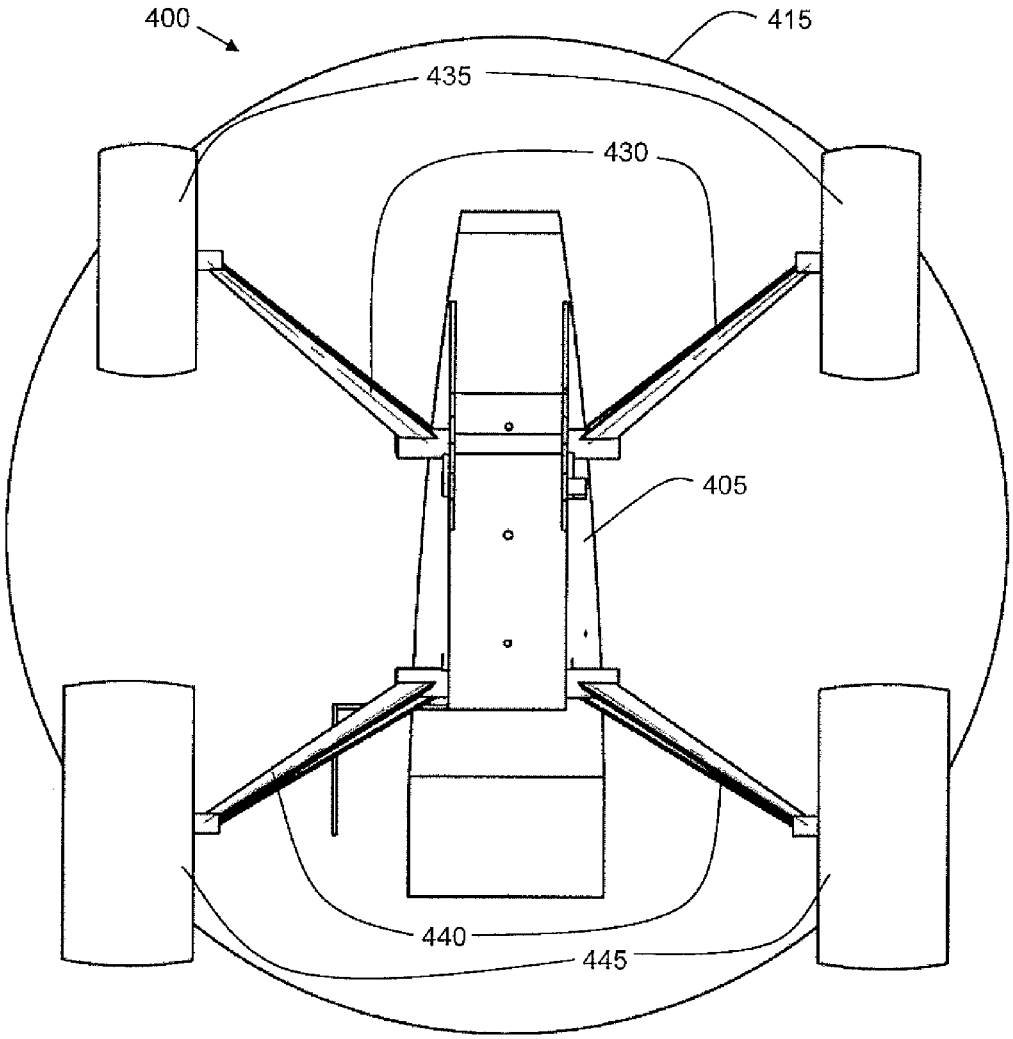
FIG. 28 is a bottom view of the embodiment of FIG. 26.

Referring now to FIGS. 26 to 28, in at least one embodiment, toy vehicle 400 has vehicle body 405, first lifting blade 410 and second lifting blade 415. First lifting blade 410 is attached to first drive shaft 420 and second lifting blade 415 is attached to second drive shaft 425. First drive shaft 420 and second drive shaft 425 are driven by first and second motors respectively (not shown) which are powered by a power source such as a battery (not shown). Vehicle body 405 is supported by front suspension 430 attached to front wheels 435, and rear suspension 440 attached to rear wheels 445. Front suspension 430 and rear suspension 440 are fully independent with respect to each of wheels 435 and 445 respectively, and each of front suspension 430 and rear suspension 440 have a long travel to absorb impact while landing the toy vehicle from an airborne position.

Figure 29A:
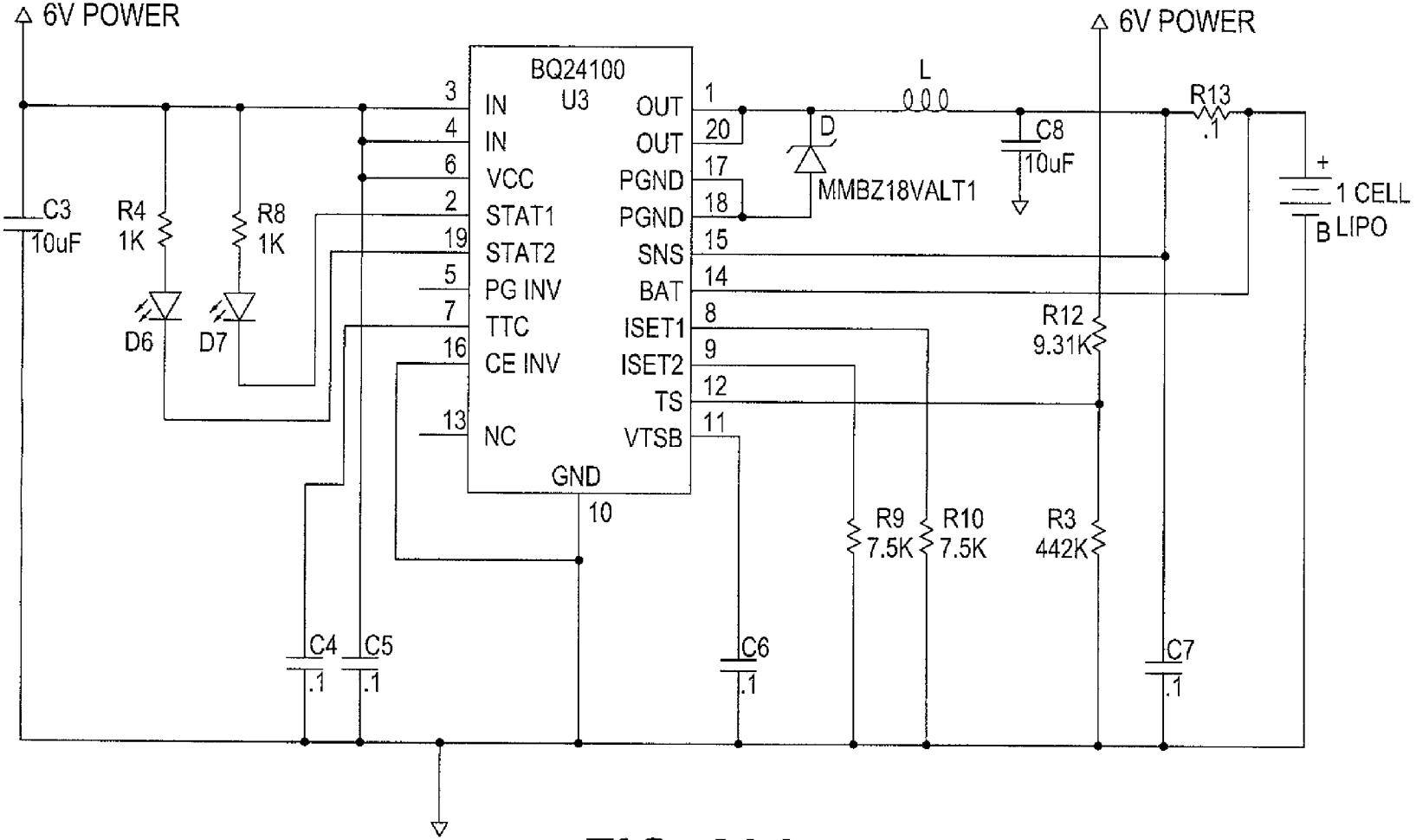
Figure 29B:
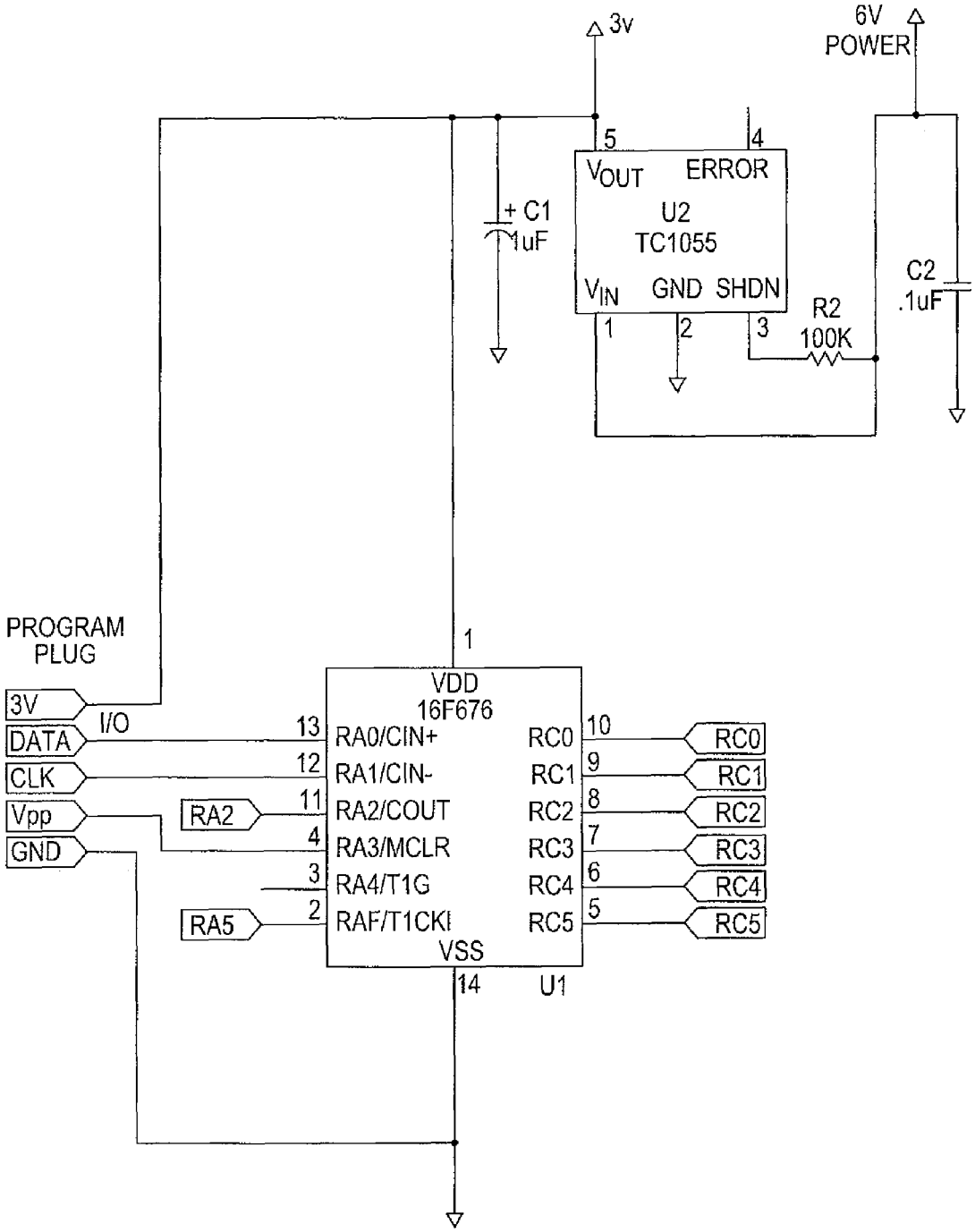
Figure 29C:
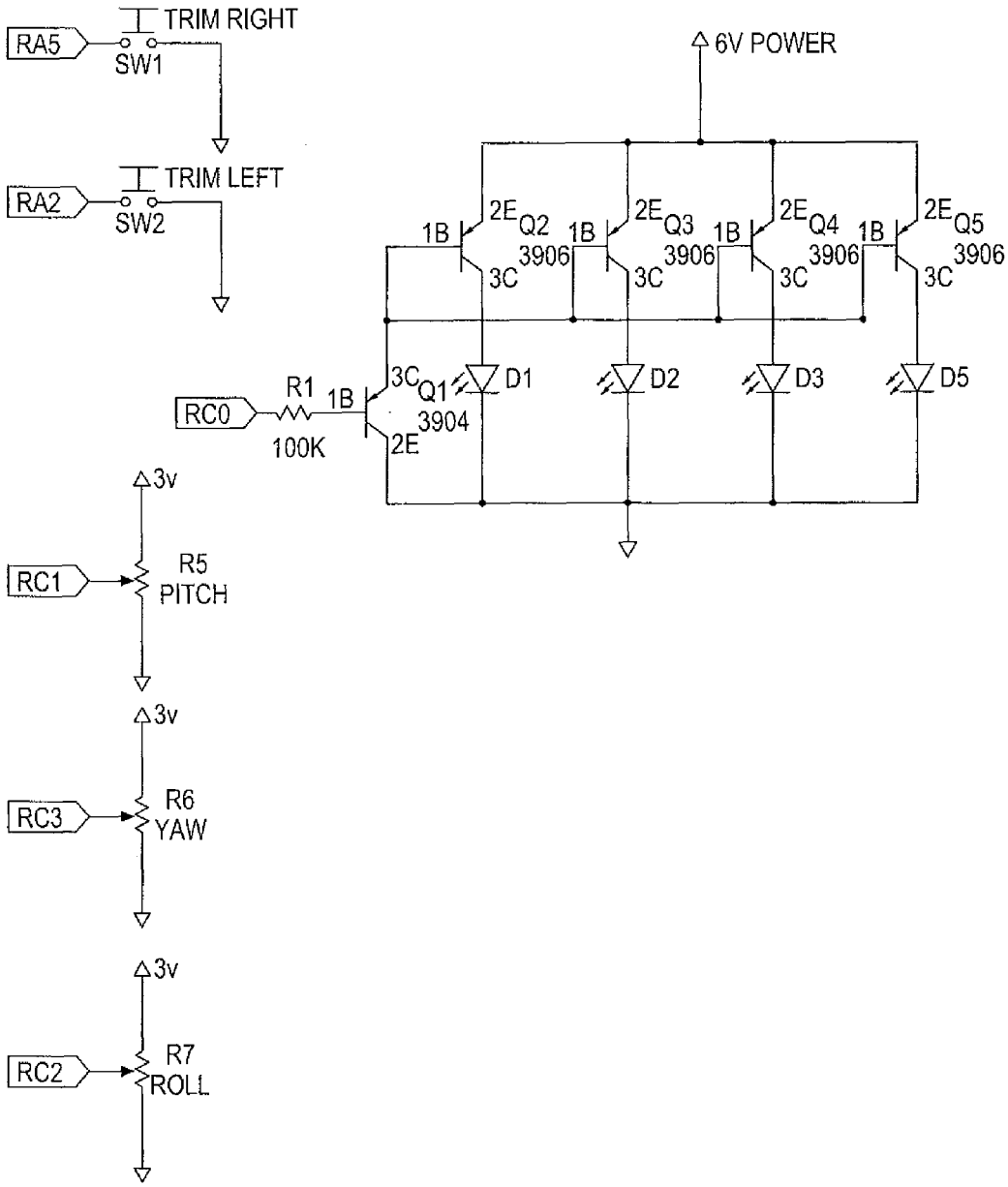
Figure 30:
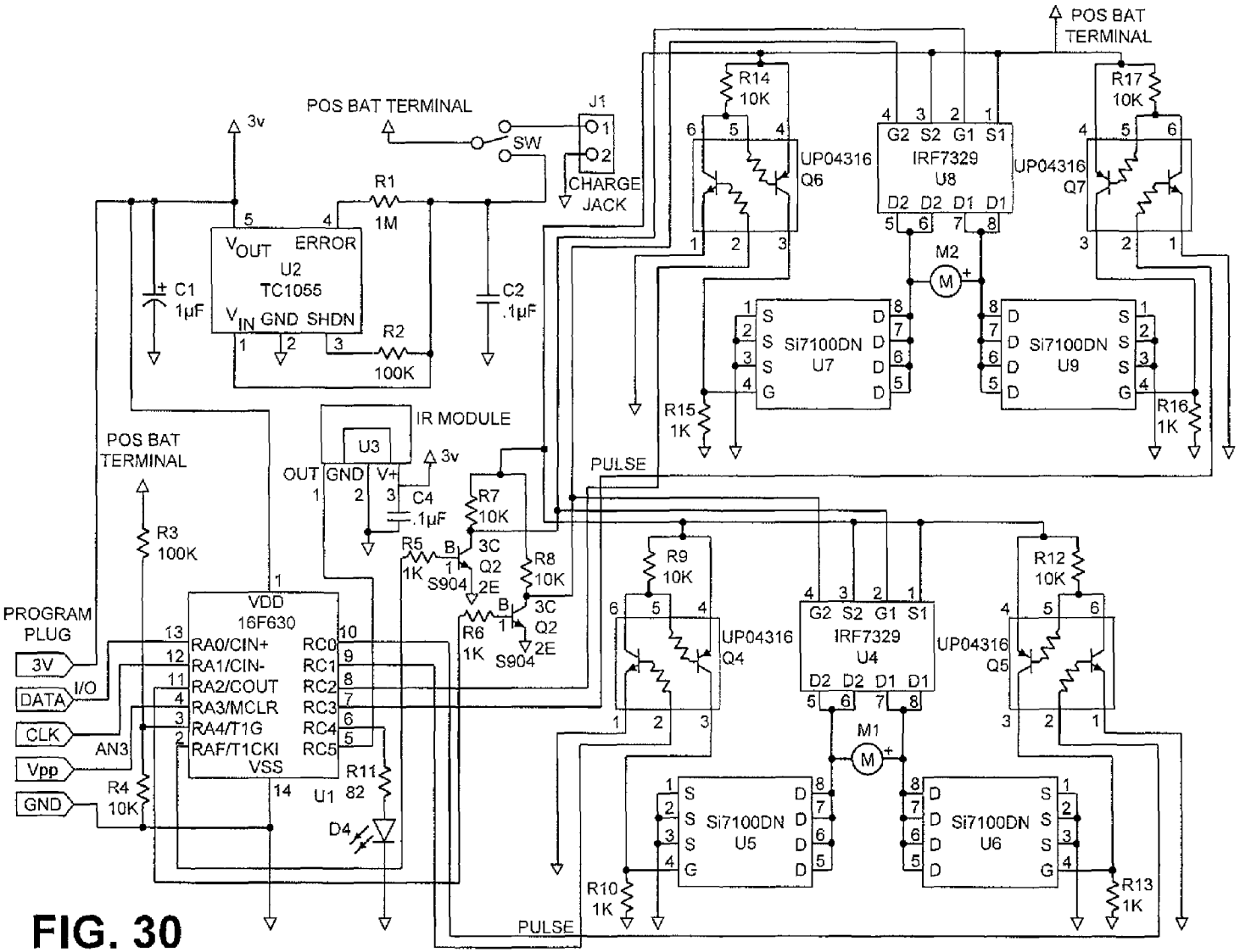
FIG. 30 is a circuit diagram for a remote control receiver for the toy vehicle of FIG. 26.

In at least one embodiment, toy vehicle 400 is controlled by a remote control unit (not shown). FIGS. 29A to 29C show circuit diagrams for cooperating controls for at least one embodiment of a remote control transmitter and FIG. 30 shows a circuit diagram for at least one embodiment of a vehicle control unit receiver, by the use of which the present toy vehicle 400 can be commanded to carry out the various functions described below.

In operation, a user can cause toy vehicle 400 to move over a ground surface by operating a control on a remote control transmitter unit which activates the application of power to the first motor driving first drive shaft 420 and to the second motor driving second drive shaft 425 so as to cause first lifting blade 410 and second lifting blade 415 to rotate in opposite directions to each other. Activating controls on the remote control unit which increase the power to the first motor driving first drive shaft 420 and to the second motor driving second drive shaft 425 increases the rotation speed of first lifting blade 410 and second lifting blade 415, so as to lift toy vehicle 400 off the ground into a flying position. Toy vehicle 400 can be steered by activating controls on the remote control unit which apply power differentially to the first motor driving first drive shaft 420 and to the second motor driving second drive shaft 425 so as to rotate first lifting blade 410 and second lifting blade 415 at different speeds.

Figure 31:
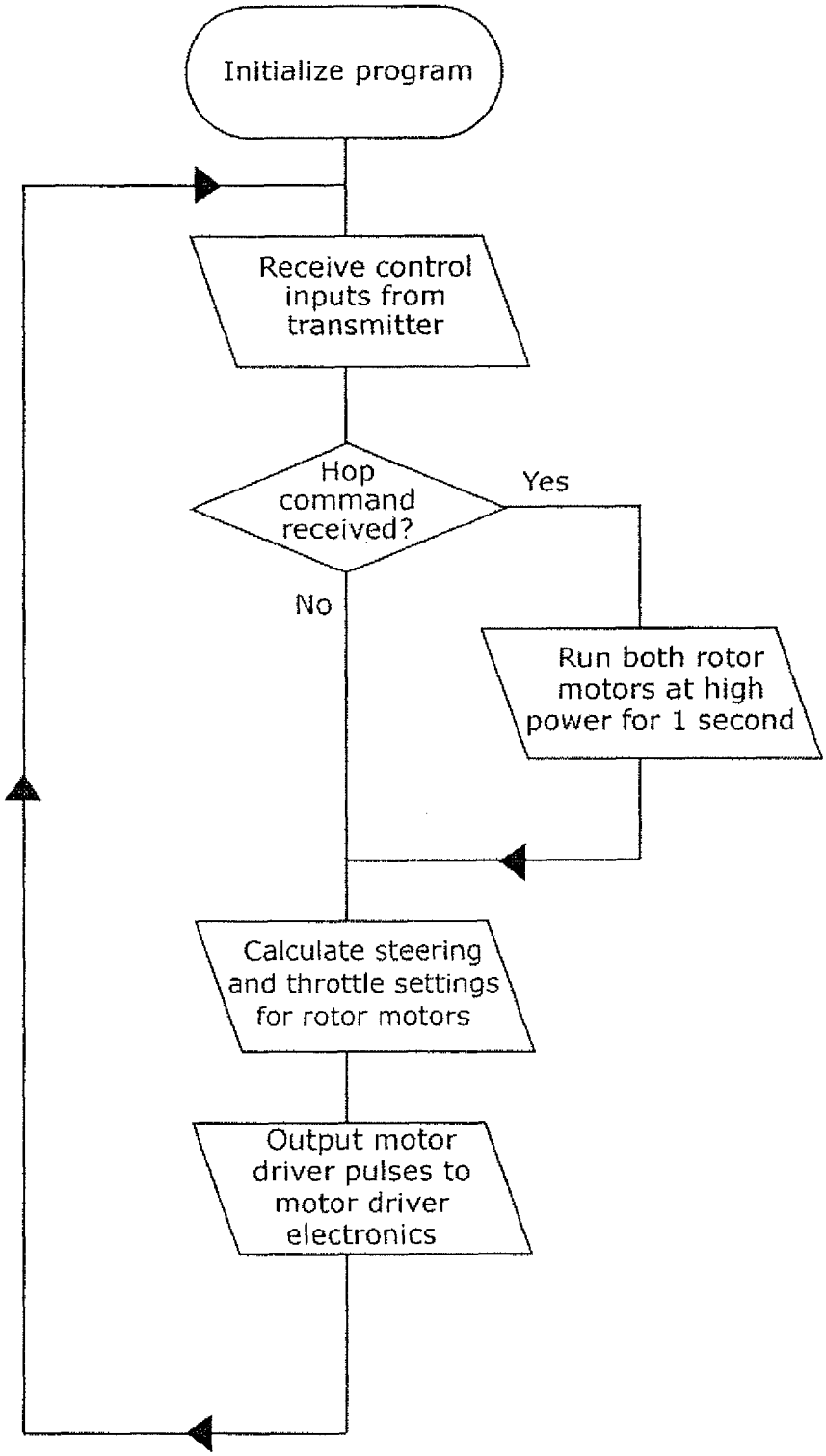
FIG. 31 is a flow chart for the "jump" function of the toy vehicle of FIG. 26.

If it is desired that the toy vehicle 400 jump over an obstacle in its path, the user can effect a "jump" function by activating a control, such as, for example, pressing a "JUMP" or "HOP" button on the remote control. A preprogrammed function of the vehicle control unit, such as that shown as a flow chart in FIG. 31, acts to increase the power to the first motor driving first drive shaft 420 and to the second motor driving second drive shaft 425 to a preset high power level for a preset time, for example, 1 second, allowing the toy vehicle 400 to become airborne. The preset high power level needed to raise the toy vehicle into flight will be readily determined by the skilled person. The power is then reduced to a preset reduced power level so that the toy vehicle is not able to sustain level flight and begins to drop softly back to the ground where it can land gently. The reduced power level can be a particular fraction, for example, 50%, of the preset high power level, or another convenient power level, such as, for example, the level of power required to move the toy vehicle over the ground, or the level of power applied to the first and second motors immediately prior to the "JUMP" button being pressed.

Repeatedly pressing the "JUMP" button will repeat the preprogrammed increase of power to the first motor driving first drive shaft 420 and to the second motor driving second drive shaft 425, such that the toy vehicle will achieve a higher altitude or remain airborne in a hovering position until the user stops pressing the "JUMP" button. Once the "JUMP" button is no longer being pressed, the power will be reduced to the preset reduced power level as described above. If the toy vehicle 400 has reached a high altitude such that its descent becomes too rapid, the user can press the "JUMP" button one or more times to intermittently raise the power level to the first motor driving first drive shaft 420 and to the second motor driving second drive shaft 425 so as to slow the descent and allow the toy vehicle 400 to land softly.

When it is desired to drive the toy vehicle 400 in a reverse direction, the user can activate a reverse control, such as, for example, by pushing a joystick on the remote control in the "REVERSE" direction, which reverses the rotational direction of first lifting blade 410 and second lifting blade 415, while simultaneously acting to compress rear suspension 440 and extend front suspension 430, by means well known in the art, so as to tilt vehicle body 405 rearwards. This in turn tilts the angle of first drive shaft 420 and second drive shaft 425 rearwards by about 10 to about 15 degrees, so as to increase the reverse thrust of the blades and give the toy vehicle 400 more speed in the reverse direction. When the user desires to again drive toy vehicle 400 in a forward direction, the reverse control can be counteracted, such as for example by releasing a joystick on the remote control from the "REVERSE" direction and/or by pushing a joystick on the remote control in the "FORWARD" direction, such that the rotational direction of first lifting blade 410 and second lifting blade 415 is again reversed, rear suspension 440 is re-extended and front suspension 430 is re-compressed, so as to return vehicle 405 from its rearward tilt. This returns the angle of first drive shaft 420 and second drive shaft 425 to a more nearly perpendicular position, so that the toy vehicle 400 can be more readily lifted off the ground.

It will be appreciated by persons skilled in the art that the present toy vehicle is not limited by what has been particularly shown and described hereinabove. Rather the scope of the present invention includes both combinations and sub combinations of the various features described hereinabove as well as variations and modifications which would occur to persons skilled in the art upon reading the specification and which are not in the prior art.

The invention claimed is:

1. A toy vehicle comprising:

a vehicle body;

a support system attached to the vehicle body, the support system configured to support the vehicle body for movement in contact with a ground surface;

a rotating blade system attached to the vehicle body, the rotating blade system configured for driving the toy vehicle on the ground surface and for lifting the toy vehicle from contact with the ground surface, wherein the rotating blade system comprises:

a first lifting blade;

a second lifting blade;

a first drive shaft operatively connected to the first lifting blade and defining an axis of rotation;

a second drive shaft operatively connected to the second lifting blade on the same axis of rotation;

a first motor configured to drive the first drive shaft and the first lifting blade at a first rotational speed and in a first rotational direction; and a second motor configured to drive the second drive shaft and the second lifting blade at a second rotational speed and in a second rotational direction;

a power source; and a vehicle control unit for controlling said support system and said rotating blade system in response to remote control signals, said vehicle control unit comprising:

a microprocessor with memory; and a receiver for receiving said remote control signals;

wherein the first rotational speed and the second rotational speed are controlled independently of each other; and wherein the toy vehicle is steered by controlling the first rotational speed and the second rotational speed.

2. The toy vehicle according to claim 1 wherein the support system comprises a suspension system and a plurality of wheels configured to engage the ground surface.

3. The toy vehicle according to claim 2 wherein the suspension system has independent suspension for each wheel.

4. The toy vehicle according to claim 2 wherein the suspension system has a long travel.

5. The toy vehicle according to claim 2 wherein the suspension system comprises a front suspension and a rear suspension and wherein the front suspension and rear suspension are each configured for extension and compression independently of each other.

6. The toy vehicle according to claim 5 wherein each of the extension and compression of each of the front suspension and the rear suspension are configured for control by the vehicle control unit.

7. The toy vehicle according to claim 6 wherein the first rotational direction and the second rotational direction are each independently selected from clockwise and counterclockwise rotational directions.

8. The toy vehicle according to claim 6 wherein the first rotational direction is opposite to the second rotational direction.

9. The toy vehicle according to claim 6 wherein the microprocessor is programmed such that:

when the toy vehicle is in forward motion, the first rotational direction is a forward first rotational direction and the second rotational direction is a forward second rotational direction and the support system adapts a forward suspension configuration; and when the receiver receives a remote control reverse signal, the vehicle control unit acts to modify the first rotational direction to a reverse first rotational direction and to modify the second rotational direction to a reverse second rotational direction, wherein the forward first rotational direction is opposite to the reverse first rotational direction and wherein the forward second rotational direction is opposite to the reverse second rotational direction; and the vehicle control unit controls the support system to adopt a reverse suspension configuration wherein the front suspension is extended and the rear suspension is compressed relative to the forward suspension configuration, such that the toy vehicle is adapted for travel in reverse motion.

10. The toy vehicle according to claim 1 wherein the first rotational direction and the second rotational direction are each independently selected from clockwise and counter-clockwise rotational directions.

11. The toy vehicle according to claim 1 wherein the first rotational direction is opposite to the second rotational direction.

12. The toy vehicle according to claim 1 wherein the microprocessor is programmed such that, when the receiver receives a remote control jump signal, the vehicle control unit acts to apply a preset high power level to the rotating blade system for a preset time and to apply a preset reduced power level when the preset time has elapsed.

* * * * *